United States Patent [19]

Noyes et al.

[11] 4,268,971

[45] May 26, 1981

[54] OPTIMUM LOW PROFILE CONTINUOUS CROSSFLOW GRAIN DRYING AND CONDITIONING METHOD AND APPARATUS

[76] Inventors: Ronald T. Noyes, 901 Eastwood Dr.; Gregory A. Lynch, 1256 N. John; Eugene E. Williams, 1009 Given St., all of, Frankfort, Ind. 46041

[21] Appl. No.: 82,812

[22] Filed: Oct. 9, 1979

[51] Int. Cl.[3] ..... F26B 3/04

[52] U.S. Cl. ..... 34/34; 34/47; 34/65; 34/169; 34/174

[58] Field of Search ..... 34/65, 169, 174, 34, 34/33, 47, 168

[56] References Cited

U.S. PATENT DOCUMENTS

| | | | |
|---|---|---|---|
| 1,502,858 | 7/1924 | Little, Jr. | 34/65 |
| 3,629,954 | 12/1971 | Lavalier | 34/174 |
| 4,004,351 | 1/1979 | Sanneman | 34/174 |
| 4,067,120 | 1/1978 | Bradford | 34/65 |
| 4,106,212 | 8/1978 | Batterton | 34/174 |
| 4,141,155 | 2/1979 | Benson | 34/174 |

*Primary Examiner*—Larry I. Schwartz
*Attorney, Agent, or Firm*—Henderson & Sturm

[57] ABSTRACT

A grain drying and conditioning apparatus having a housing with an outer pervious skin with impervious end walls, air inlet, grain inlet, grain outlet and air exhaust duct structures connected thereto has air pervious walls which are spaced within the structure for confining a column of grain to be dried. A blower and heater mechanism is also connected to the housing for causing heated air to be forced through a first zone of the column of grain in one direction to heat and extract moisture therefrom and simultaneously causing air for cooling the grain to be pulled through a second zone of the grain column in an opposite direction, or, by simple adjustments, to be pushed in the same direction as the flow of the heated air. A plenum chamber is formed between the innermost of the pervious walls, the air duct structure, and a rear bulkhead wall opposite the air duct structure; an adjustable plenum divider mechanism is provided between the innermost of the pervious walls and the air duct structure in the plenum chamber for selectively dividing the plenum chamber into a first and a second section for the purpose of optimizing the heating and cooling of the grain in the first and second zones, or for combining both zones of the plenum chamber for optimum heated air drying in the entire structure.

Air recycling structure and specific air control devices for regulating the volume of exhaust air versus recycled air in the exhaust areas of the dryer is provided for blending unsaturated exhaust heated air which was forced through the lower portion of the first zone (drying zone) of the grain column area by pressure with incoming cooling air drawn through the second zone (cooling zone) of the grain column area by suction to save the energy in such heated air.

29 Claims, 21 Drawing Figures

OPTIMUM LOW PROFILE CONTINUOUS CROSSFLOW GRAIN DRYING AND CONDITIONING METHOD AND APPARATUS

BACKGROUND OF THE INVENTION

The present invention relates generally to grain drying equipment and more particularly to an improved low profile continuous crossflow column grain dryer with optimum dryer air recirculation within the grain column and automatic self cleaning heat plenum chamber.

It is generally believed that continuous crossflow dryers, that is, those dryers which have wet grain continually entering the dryer and dried grain continually exiting the dryer with drying air passing across the flowing column of grain, were not suitable for drying grains having a high moisture content. The reason for the difficulties experienced in the use of conventional continuous crossflow dryers was that they only operated at their optimum design performance over a fairly narrow band of moisture removal range due to fixed design conditions such as a fixed cooling air flow, and a fixed heated air flow.

At a grain moisture removal of 6 to 8 percentage points, most conventional dryers work satisfactorily. The cooling rate is matched fairly well with the drying rate. The grain column is usually split 25–35 percent cooling and 65–75 percent heating. The total blower horsepower is normally split to be 30–40 percent cooling and 60–70 percent drying. Dryers with 25 percent cooling column usually use the upper extreme in cooling horsepower, thus operating the cooling plenum at a higher static pressure that the heating plenum and delivering 50–100 percent more cool air per bushel than drying air.

Under conditions wherein grain coming from the field is very high in moisture, and the drying rate is slowed significantly, the grain in such prior art systems was over cooled, which is not a particular problem from the standpoint of the quality of the grain dried, but it does waste considerable energy. Under very dry grain inlet conditions wherein the moisture removal is in the 3–5 percentage range, grain flow rate is very high and cooling is inadequate. If grain conditioned by such a process is to be stored in a non-aerated storage and therefore has to be cooled considerably after being dried in the dryer, the only reasonable solution was believed to be to cut back on the drying temperature to drastically slow down the drying rate to the point at which the grain retention time in the cooling zone was adequate to cool the grain. It is well known that the efficiency of the drying process is reduced and the fuel cost is very high when the plenum operating temperature of a cross flow dryer is significantly reduced. It is also well known that the grain to be stored in non-aerated storage cannot be too hot or it will deteriorate. There is, therefore, the need for a continuous flow drying apparatus which will overcome these problems found with prior art devices.

Another weakness with most conventional continuous crossflow column grain drying devices is that when drying grains under conditions where cooling the grain in the dryer is not desired, the cooling air flow must be blocked off and the cooling grain column is of little or no value in drying. There is, therefore, a need for equipment of this type which will adequately compensate for this situation by having a design that can be easily adjusted to provide drying of grain in the grain column area normally used for cooling to maximize the performance and capital investment of the dryer.

It is also known that crossflow dryers are normally: (1) of a full pressure design, using positive pressure in a heating as well as a cooling plenum, or (2) designed with suction cooling and pressure heating. But, they do not in one common structure embody the capability to perform in either method with quick and easy adjustment between the methods, a management capability thought to be highly desirable, especially in farming regions where grain sorghum (milo) or sunflowers (both of which are crops with abnormally high combustible seed coat particles which accumulate in the heat plenums of dryers that recirculate the suction cooling air through the burner, causing fires in the dryer plenum or grain column) plus other cereal grain crops are grown in one farming operation. Having a dryer capable of being easily converted in a matter of a few minutes would allow full pressure heating and cooling of milo, sunflowers, or other crops with flammable residue, to be dried with pressure heating and cooling using only ambient air with no recycled exhaust air. Then, when it is desirable to dry corn, wheat, soybeans or other safer crops with residue that is considerably less flammable, the dryer can be adjusted for suction cooling plus recycling of the recycling of the less humid portion (approximately half) of the exhaust heated air, thus, reducing fuel consumption by 35 to 50 percent of the fully pressurized and cool process fuel costs, while not significantly affecting drying capacity.

SUMMARY OF THE INVENTION

The present invention relates to a grain drying and conditioning apparatus having a housing with an outer pervious skin with impervious end walls, air inlet, grain inlet, grain outlet and air exhaust duct structures connected thereto. Air pervious walls are spaced within the structure for confining a column of grain to be dried. A blower and heater mechanism is also connected to the housing for causing heated air to be forced through a first zone of the column of grain in one direction to heat and extract moisture therefrom and simultaneously causing air for cooling the grain to be pulled through a second zone of the grain column in an opposite direction, or, by simple adjustments, to be pushed in the same direction as the flow of the heated air. A plenum chamber is formed between the innermost of the pervious walls, the air duct structure, and a rear bulkhead wall opposite the air duct structure; an adjustable plenum divider mechanism is provided between the innermost of the pervious walls and the air duct structure in the plenum chamber for selectively dividing the plenum chamber into a first and a second section for the purpose of optimizing the heating and cooling of the grain in the first and second zones, or for combining both zones of the plenum chamber for optimum heated air drying in the entire structure.

Air recycling structure and specific air control devices for regulating the volume of exhaust air versus recycled air in the exhaust area of the dryer is provided for blending unsaturated exhaust heated air which was forced through the lower portion of the first zone (drying zone) of the grain column area by pressure with incoming cooling air drawn through the second zone (cooling zone) of the grain column area by suction to save the energy in such heated air.

An air duct containing an air impervious skin which encloses the outer pervious skin of the lower section of the drying zone directs all the very warm exhausting air from that section back to the inlet of the blower for recycling through the burner, thus re-using the heat energy again to do further drying.

The returning exhaust air mixes with the cooling air to form a blend of relatively dry warm air which is then forced back to the heater at a temperature significantly higher than outside ambient air temperature. This causes the heater to provide much less additional heat to the air to elevate the drying air to the desired heat plenum temperature level for drying the grain, thus providing a more uniform drying temperature than would be obtained by heating outside ambient air all the way to the heat plenum operating temperature level. It is commonly known that most heaters in grain dryers do not uniformly heat the air, thus the lower heat rise required provides a safer, more uniform, plenum heat level.

The lower required temperature rise at the heater due to the recycled cooling and heating air results in a very significant savings in energy needed to dry the grain.

By drawing cooling air through the grain in the cooling zone, into the inlet of the blower, then pushing it through the drying zone, the blower can handle more total airflow even though the inlet air has been warmed (thus reducing the air density and thus the pounds of dry air the fan is handling), compared to the size fan needed when using ambient outside air to pressure heat and cool the grain. Using a smaller fan reduces the capital cost of equipment, keeping the consumer's price at a lower level.

A novel feature of the invention is an air control box built adjacent the air duct as part of the transition which has a hinged air duct floor that is used as an air splitter at the outlet of the blower. An air return door or doors on the air control box are operated in conjunction with the "air splitter" to provide two way flow control of airflow through the box. An open end of the air box is connected to an opening into the cooling air plenum or cooling zone below the plenum divider floor.

With the air return door or doors open and the "air splitter" closed, suction from the blower inlet causes cooling air to flow through the air control box and back to the inlet of the blower. By closing the air return doors and selectively opening the "air splitter" to one of several positions available, forced or pressure cooling can be accomplished by pushing ambient outside air from the blower through the air box and into the cooling plenum thus, forcing it through the grain. This provides positive control of cooling by splitting off only as much cooling air as required; the remainder of the blower airflow is used for drying.

Pressure cooling is used when the crop being dried has residue that has very flammable characteristics and is quite easily ignited such as grain sorghum (milo) dust, fuzz, and hulls, or sunflower seed "hairs" (which are quite oily).

An object of the present invention is to provide an improved grain drying apparatus.

Another object of the invention is to improve the control and use of the cooling zone of the dryer by being able to easily and readily adapt the area of grain column normally used for cooling to additional drying area, thus increasing the drying capacity and efficiency of the drying apparatus by using the entire grain column for heated air drying.

Still another object of the invention is to provide an apparatus for controlling the amount of exhaust air released to atmosphere based on the humidity of the portion of the exhaust air coming from the lower exhaust zone so that the dryer efficiency is further improved.

Another object of the invention is to control the volume of the drier exhaust heated air containing economically usable drying energy and return it to the blower for blending with cooling air and free ambient air to reduce the fuel consumption of the device while drying grain, thus providing a dryer of significantly higher efficiency and operating economy than prior art drying systems.

Still another object of the invention is to provide a dryer which can be adjusted to provide heated air to both the first and second plenum zones so that drying of grain can be conducted throughout the grain column under conditions where no cooling is required in the dryer, thus significantly increasing the capacity of the dryer. This can be accomplished using recirculation of a desired portion of the drier exhaust air, or can be set to exhaust all air from the structure.

A further object of the invention is to provide a dryer that is safer to operate due to the more uniform heat plenum temperatures obtained when warm air is recirculated through the blower, thus minimizing or eliminating "hot spots" in the heated air entering the grain that can ignite grain or foreign material in the grain column or plenum chamber.

An additional object of the invention is to provide an automatic cleanout feature, which will remove foreign material and keep it from building up in the heat plenum where it would create a fire hazard, thus making the dryer much safer.

Other objects, advantages and novel features of the present invention will become apparent from the following detailed description of the invention when considered in conjunction with the accompnaying drawings.

DESCRIPTION OF THE PREFERRED EMBODIMENTS

Figure 1:
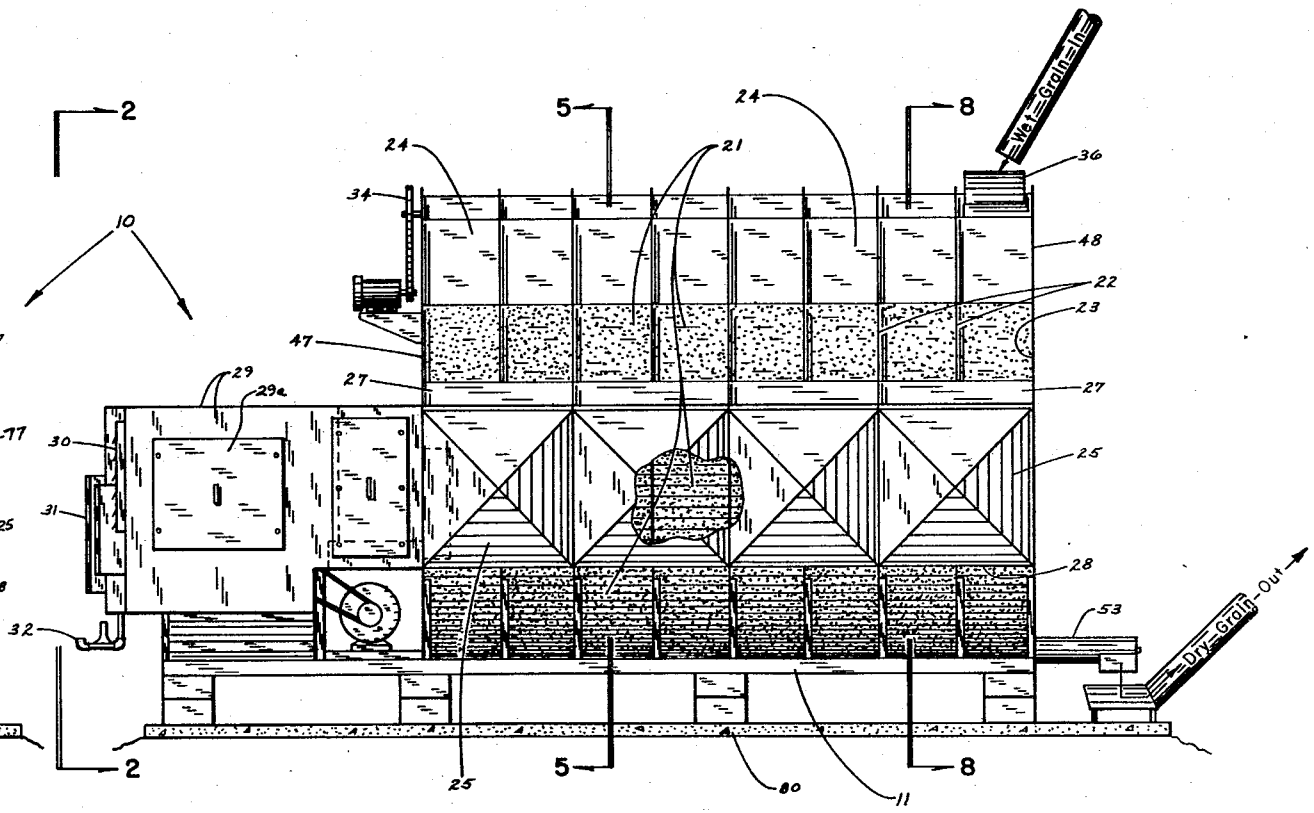
FIG. 1 is a side elevational view of a preferred embodiment of the present invention.

Referring now to the drawings, wherein like reference numerals designate identical or corresponding parts throughout the several views, FIG. 1 shows a framework of the grain dryer 10 constructed in accordance with the present invention which has an outer pervious skin 21 attached to intermediate structural members 22, and structural outer end members 23 which is attached to the outer grain column retaining wall and extends slopingly from the base of the impervious garner bin wall 24 down the vertical sidewall behind an impervious air return duct wall 25, then along the lower slope structure attaching along the center of the dryer to base frame 11.

Figure 4:
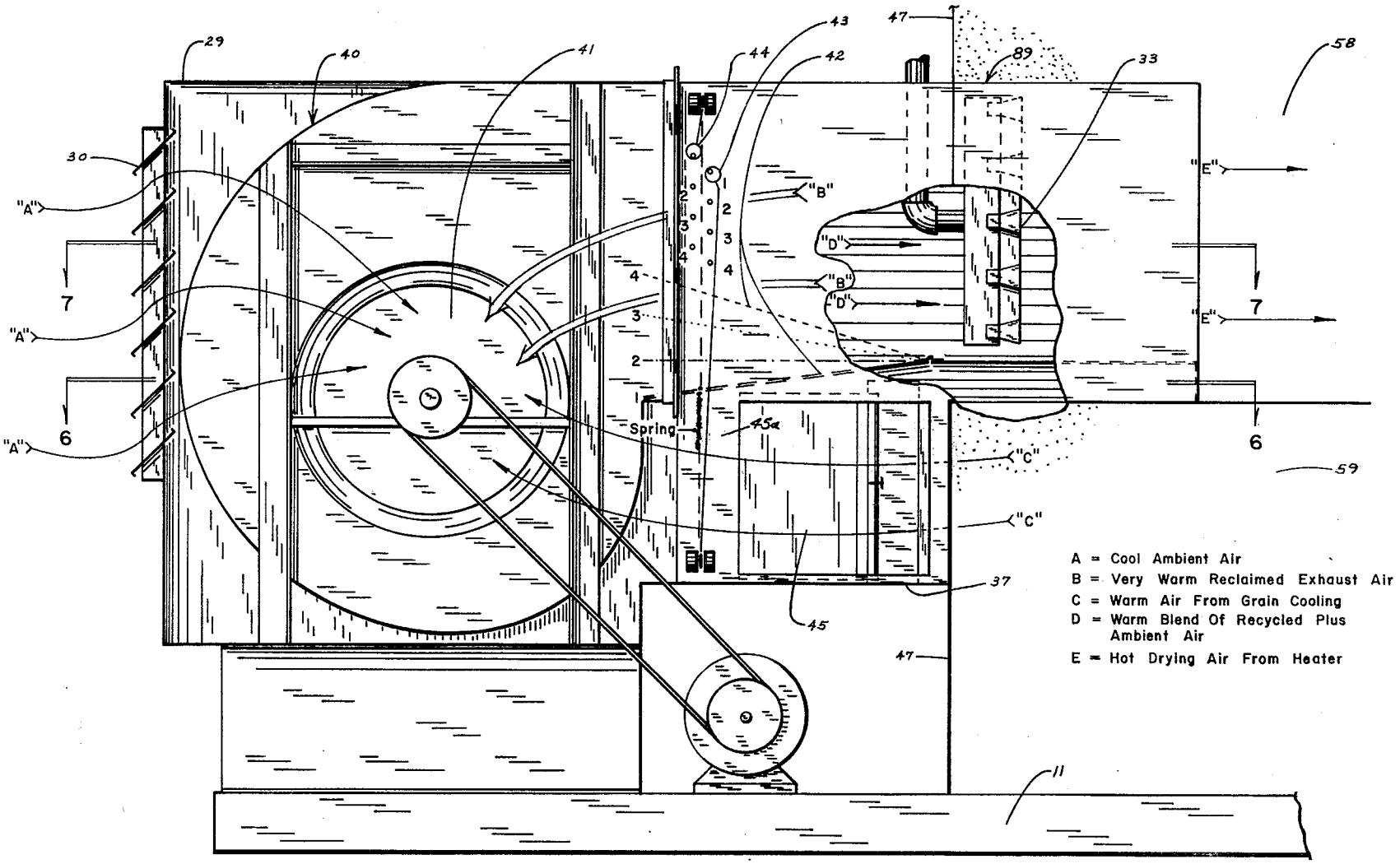
FIG. 4 is an enlarged cross-sectional view taken along line 4—4 of FIG. 2.

The return air duct 25, along the sidewall, has top exhaust vent doors 27 and bottom exhaust vent doors 28 to allow control of exhaust air for returning to the inlet opening 41 of air circulation blower 40, as can best be seen in FIG. 4, which is housed inside an air return duct housing 29 which completely encloses the centrifugal blower 40. Vaneaxial blowers 92, are also used for air circulation as can best be seen in FIG. 16, and are enclosed completely inside an air duct return housing 90 as can best be seen in FIGS. 14 and 15.

Ambient air inlet louvers or vents 30 are shown in FIGS. 1, 2, 3, 4, 6, 7, and 11, but their function is best shown in FIG. 4. Electrical control equipment is generally housed in control box 31 which is mounted adjacent the fuel plumbing train 32, FIGS. 1 and 2.

Figure 3:
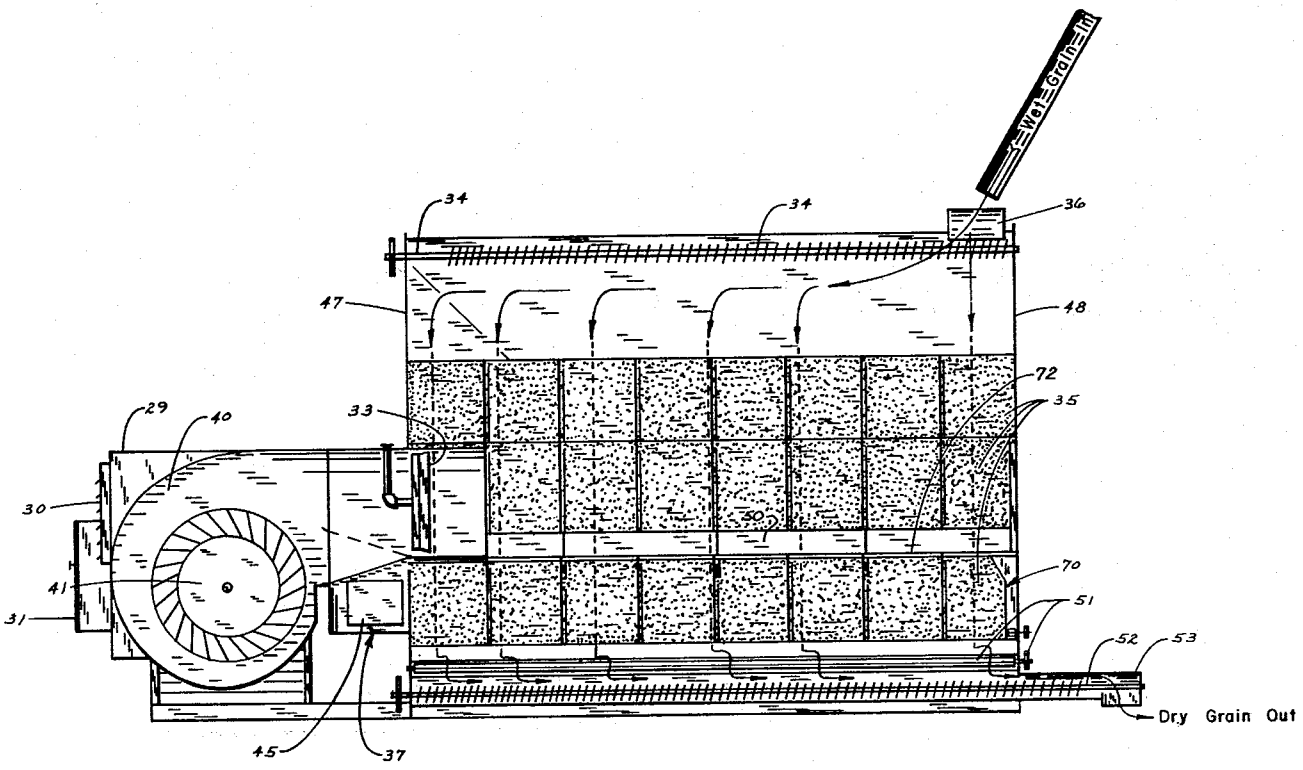
FIG. 3 is a cross-sectional view taken along line 3—3 of FIG. 2.

Grain is conveyed to the dryer fill hopper 36, FIG. 1, where it flows by gravity into the grain column 12 (FIG. 8) contained by outer pervious wall 21, FIG. 1, and inner pervious wall 35, FIG. 3. The grain fills the grain column 12, between the inner walls 75 and the outer wall 76, FIG. 8, and is contained at the lower end by metering roll 51, FIG. 3; when grain reaches a sufficient volume, the grain is leveled by leveling conveyor 34, FIG. 3, until the dryer grain column and the garner bin 39 (FIG. 8) is filled, henceforth grain level sensing controls cause the leveling auger to operate periodically, keeping the dryer filled as the dry grain is discharged by meters 51 into unload conveyor 52 where it exits from the dryer through grain unloading duct 53.

Figure 2:
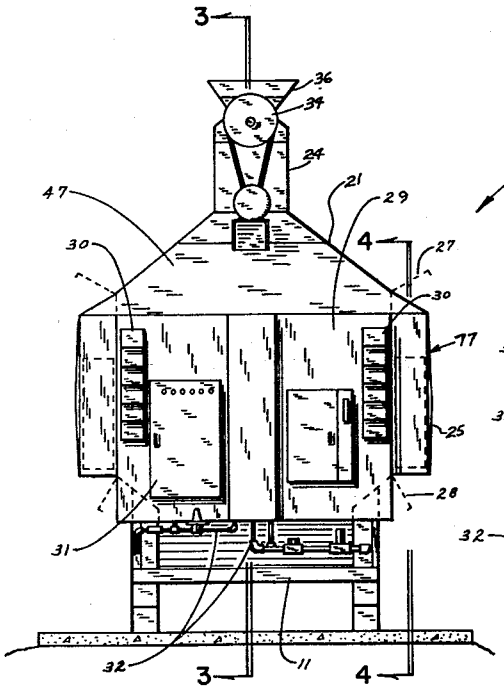
FIG. 2 is a front view of the invention taken along line 2—2 of FIG. 1.

Once the dryer has been filled with wet grain, the blower 40 is energized through use of control devices in control panel 31 (FIGS. 1 and 2). The air from the blower passes across the burner 33 best shown in FIG. 4, where it is heated to the desired level by fuel controlling devices in the fuel plumbing train 32 that monitor the fuel flow to the burner.

Referring to FIGS. 1, 2, 3, 4, 8 and 12, it is noted that the dryer body is formed by an assembly of the outer grain column structural end 23 and intermediate structural members 22 attached to pervious outer skin sheets 21 with structural spacing members 56 (FIG. 8) separating the outer pervious skin assembly 76 from a similar inner pervious skin assembly 75 consisting of inner grain column end structural members 55, FIG. 2, and intermediate structural members 54 (FIG. 8) attached to pervious inner skin panels 35 (FIG. 3). These pervious inner and outer skin assemblies are further enclosed across each end of the grain bed by front bulkhead sealing panels 47 (FIG. 12) mounted adjacent the blower and rear bulkhead panel 48 (FIG. 1).

Figure 5:
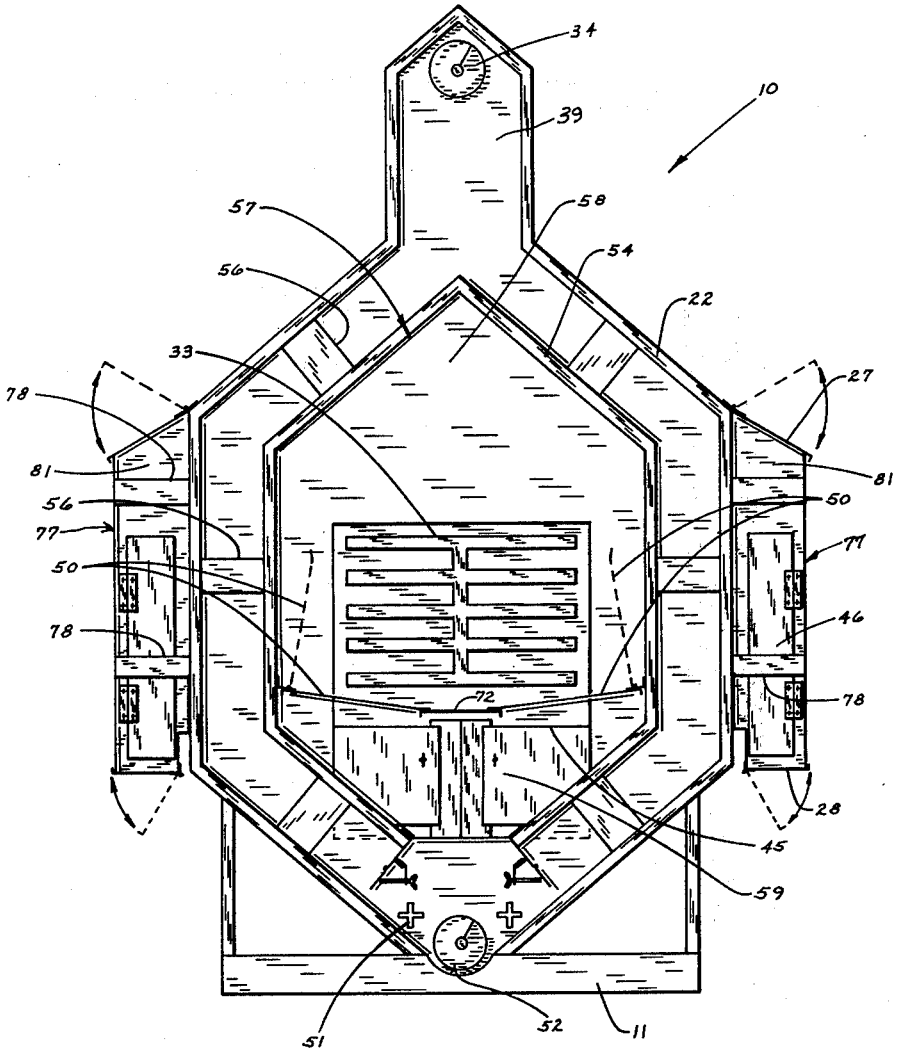
FIG. 5 is a cross-sectional view taken along line 5—5 of FIG. 1.

Referring again to FIG. 8, the cavity formed between the end bulkhead panels 47 and 48, and the pervious inner wall 75, is the air plenum 57. This volume is further defined by plenum divider panels 50 into a first zone volume, 58, used for conveying and distributing heated air into the grain column 12, and a second zone volume, 59, used primarily for suction flow cooling or pressure flow cooling of the grain, but which can be secondarily used for heated air when no cooling is desired and plenum divider panels 50 are opened, allowing full and adequate distribution of heated air from the burner 33, (FIG. 5) to be uniformly distributed through the full plenum chamber 57.

The exhaust air return duct structure 77, (FIG. 8) is mounted adjacent the intermediate or vertical portion of the grain column outer wall 76. This structure consists of sidewall panels 25, and sidewall mounting brackets 78, sealed at the end opposite the blower by an end bulkhead panel 79, FIG. 8. The top is enclosed by adjustable air exhaust panels 27 and the bottom by adjustable cleanout panels 28. At the front end of this duct where air passes the front bulkhead, an adjustable air duct control valve 46, best viewed in FIGS. 5 (closed) and 12 (open), allows control of the hot exhaust air. A bulkhead member 81 (FIG. 5) seals around the air duct valve 46.

The blower 40 (FIG. 4) is mounted to the base frame 11 and is connected to the dryer upper or heat plenum chamber 58, and front bulkhead 47 by an airflow transition assembly 37. The airflow transition assembly 89 contains a straight through airduct where air from the outlet of the blower 40 passes across burner 33, heating the air as it passes into heat plenum 58. The bottom of the upper air duct portion of the transition is a hinged panel 42 controlled by direct top mounted cable assembly 44 and spring loaded cable assembly 43 to selectively position the panel or "air splitter" to divert a desired portion of the blower outlet air into the air control box below the air splitter panel 42 that makes up the lower portion of the airflow transition assembly.

Door panels on the air control box 37 are closed when the air splitter is open and are open when the air splitter is closed. Under certain conditions which will be clearly seen later, both the top 42 and side panels 45 of the air control box may be closed for a specific use, but the dryer is never operated with both panels open.

Figure 6:
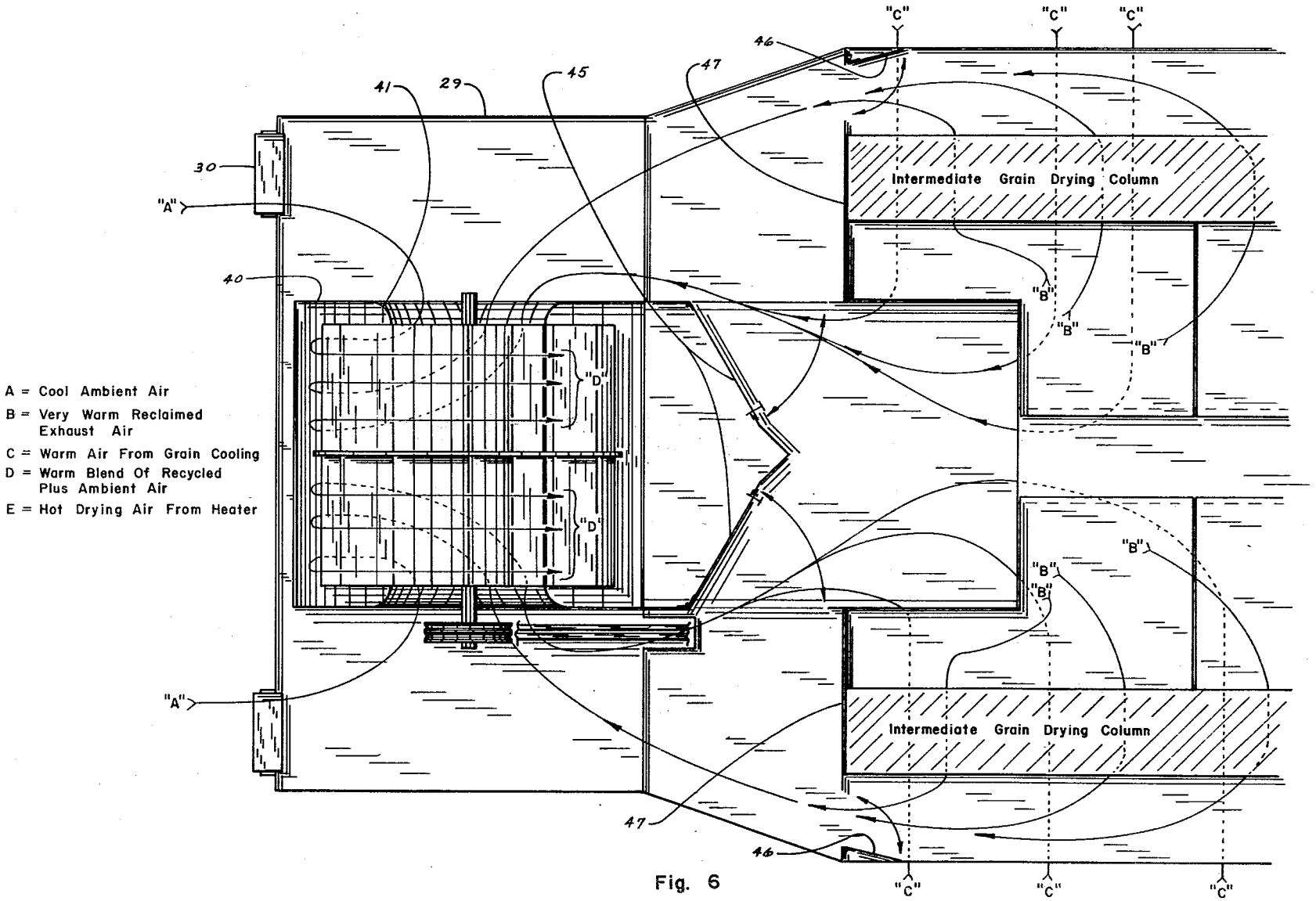
FIG. 6 is a cross-sectional view taken along line 6—6 of FIG. 4.
Figure 7:
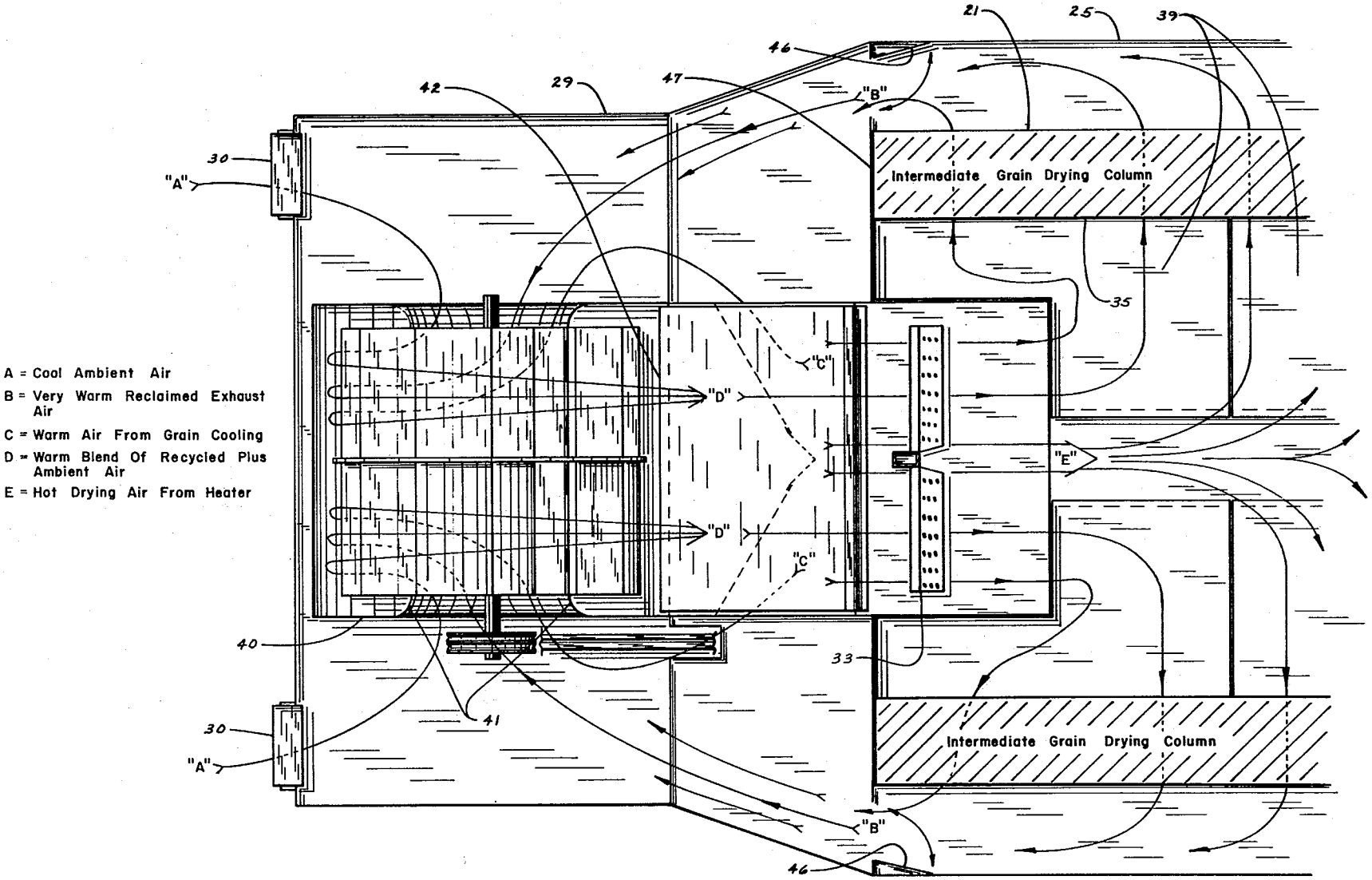
FIG. 7 is a cross-sectional view taken along line 7—7 of FIG. 4.

A weathershield air duct panel housing 29 with louvers 30, (FIGS. 1, 2, 4) surrounds the blower and transition structure on all sides and connects to the air duct assembly 77 (FIG. 8) mounted on the sidewall of the dryer to effectively route all exhaust drying air from airduct assembly 77 and all of the suction cooling air from the air control box 37 of the airflow transition assembly 89 (FIG. 3), back to the inlet 41 of the centrifugal blower 40, along with providing control of the amount of cooling airflow from the cooling louvers 30 (FIG. 6).

Figure 16:
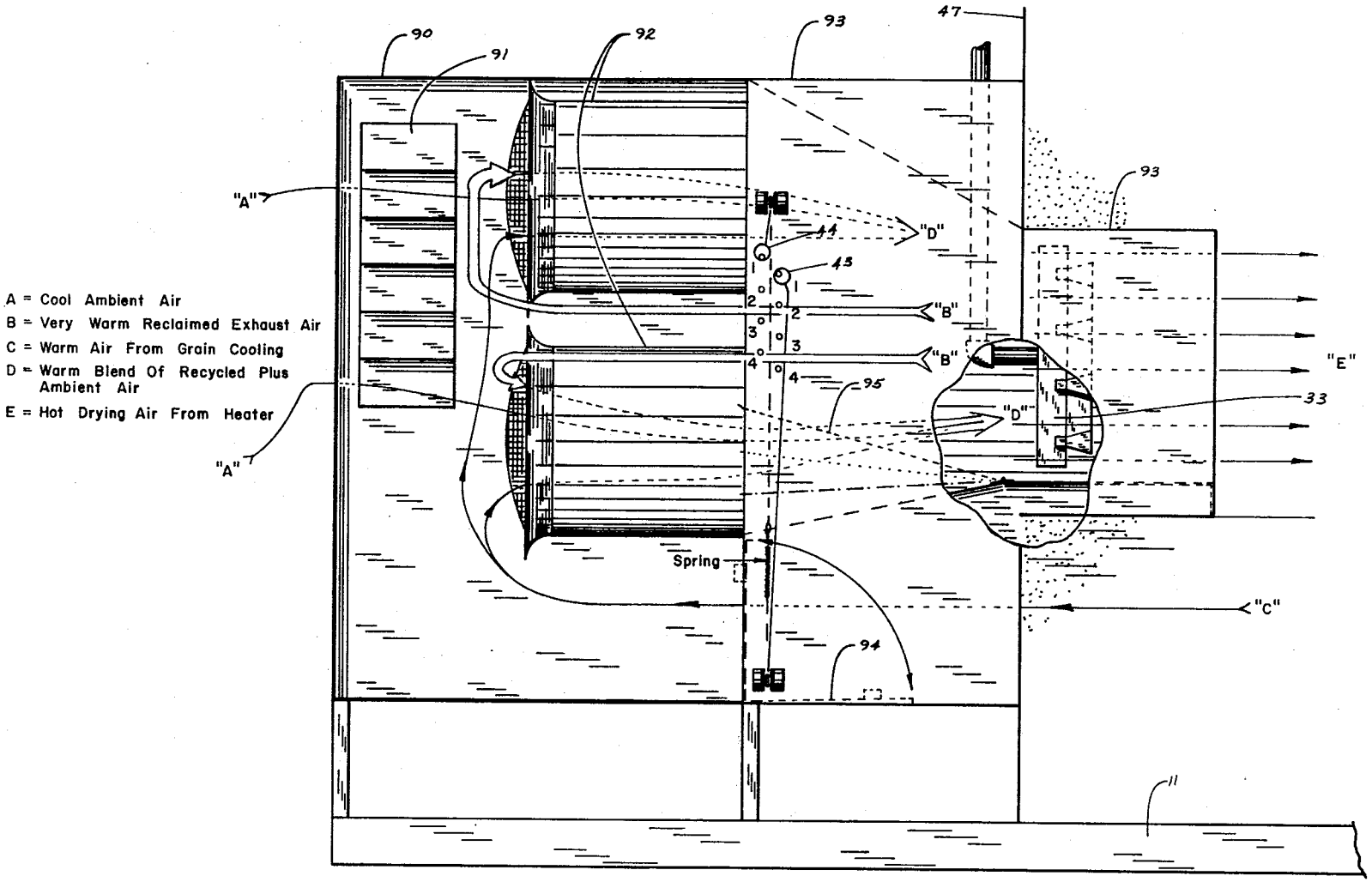
FIG. 16 is a partial cross-sectional view taken along line 16—16 of FIG. 15.

The airflow function can also be carried out by vaneaxial and other types of air moving devices. One or more vaneaxial devices 92 can be used in conjunction with an airflow transition assembly, as seen in FIG. 16, to route an airflow by pressure across a burner to heat the air in the upper plenum area for drying grain, and can cause suction to pull air through the grain in the lower plenum area for cooling the grain and reclaiming the heat, then route that warm cooling air through the open door panel at the front of the air control box at the bottom of the airflow transition assembly 89, back to the inlet of the blower or blowers (see arrow "A", FIG. 16). Arrows B in FIG. 16 show an alternate optional use of the air box where the door 94 is closed and the "air splitter" panel 95 at the top of the airflow control box is opened a desired amount to divert a portion of the blower airflow to the lower cooling plenum 59, such that the grain is adequately cooled; the remainder of the airflow from the blowers 92 is heated to dry the grain, thus optimizing cooling and providing the remainder of the airflow for drying.

Figure 14:
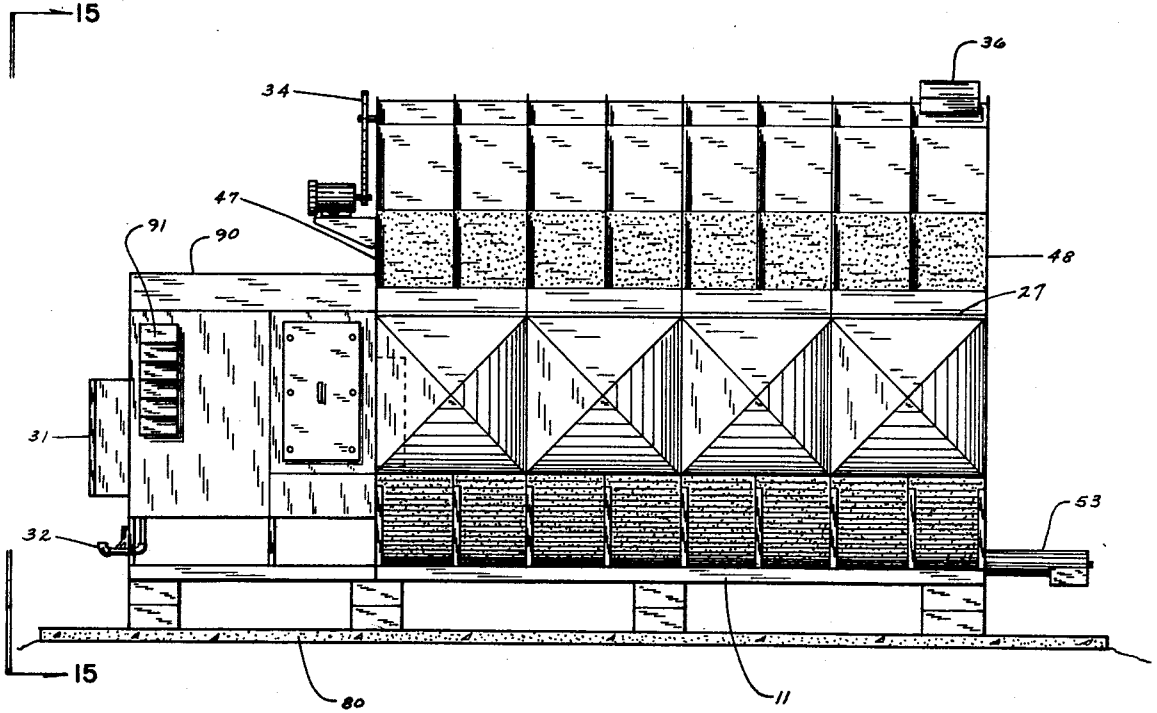
FIG. 14 is a side elevational view of a second embodiment of the present invention.
Figure 15:
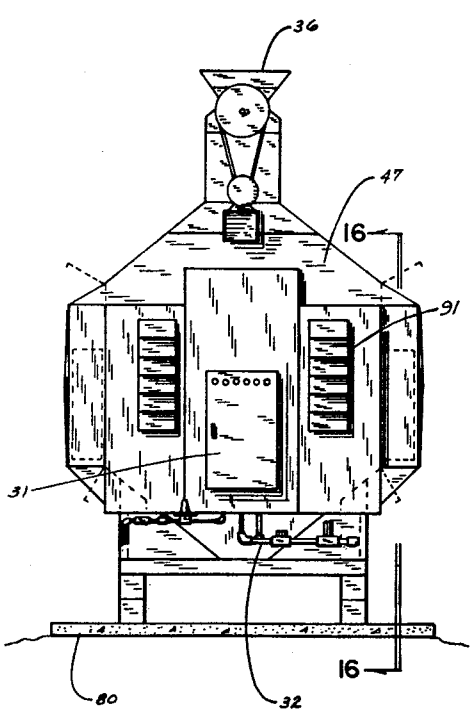
FIG. 15 is a front view of the second embodiment taken along line 15—15 of FIG. 14.

Housing 90 surrounds the vaneaxial blowers 92 and has louvers 91 for controlling ambient inlet airflow, as shown in FIGS. 14, 15 and 16.

A very important and novel feature of this invention is a method and apparatus for automatically and continuously cleaning the dust, grain particles, hulls, "hairs", and other foreign combustible material from the dryer in a continuous and automatic manner.

Figure 8:
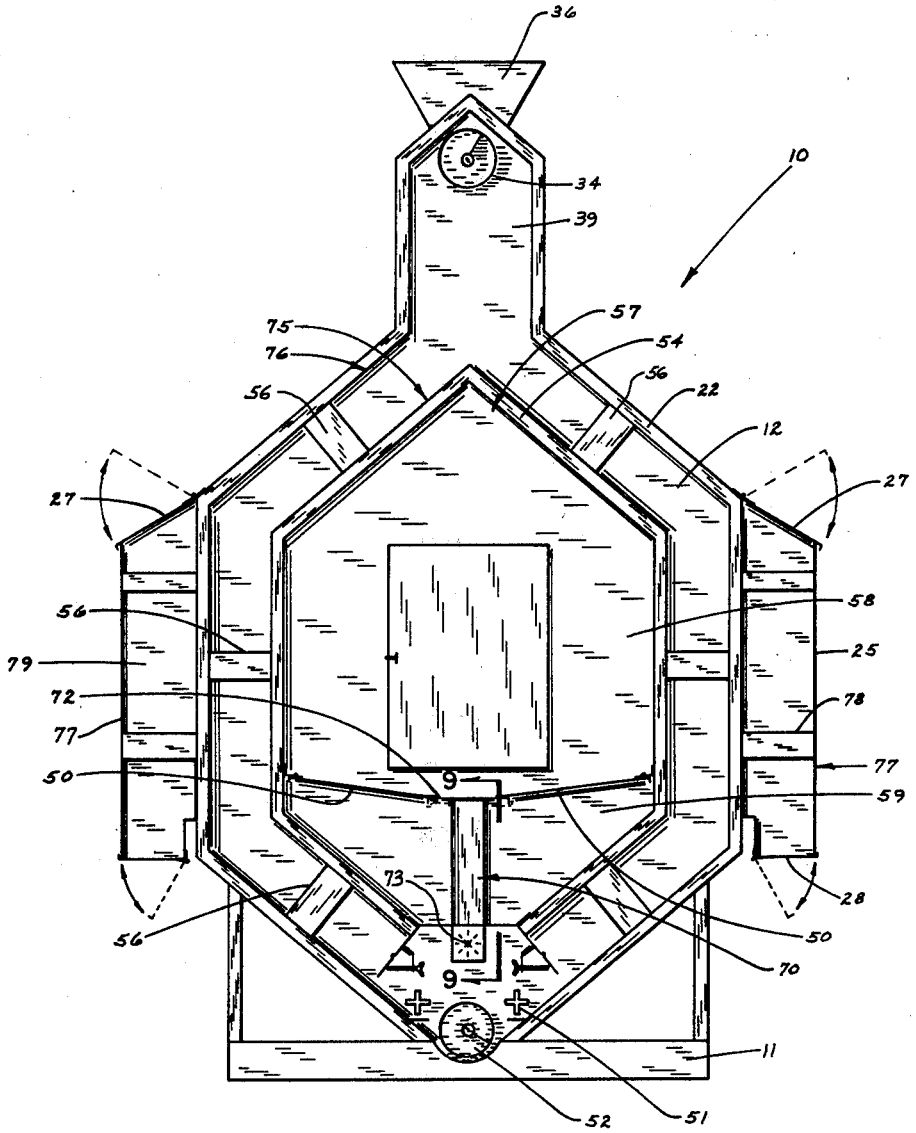
FIG. 8 is a cross-sectional view taken along line 8—8 of FIG. 1.
Figure 13:
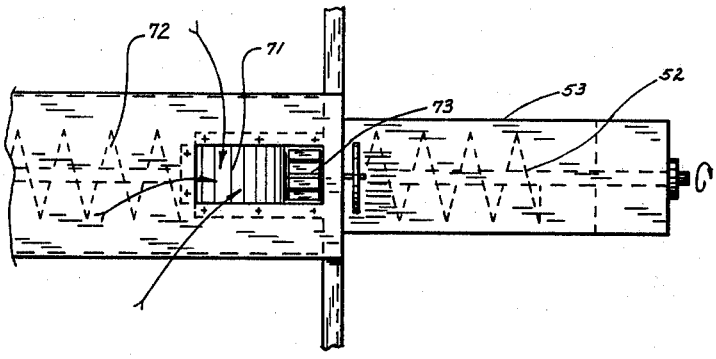
FIG. 13 is a partial cross-sectional view taken along line 13—13 of FIG. 9.
Figure 9:
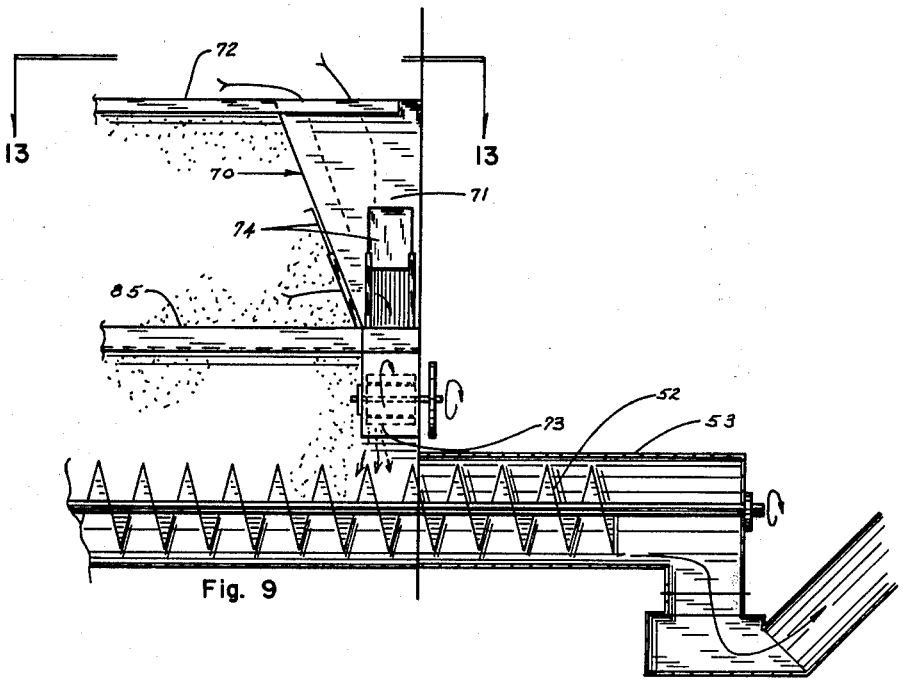
FIG. 9 is an enlarged cross-sectional view of a cleanout structure as shown in the lower right corner of FIG. 3.
Figure 10:
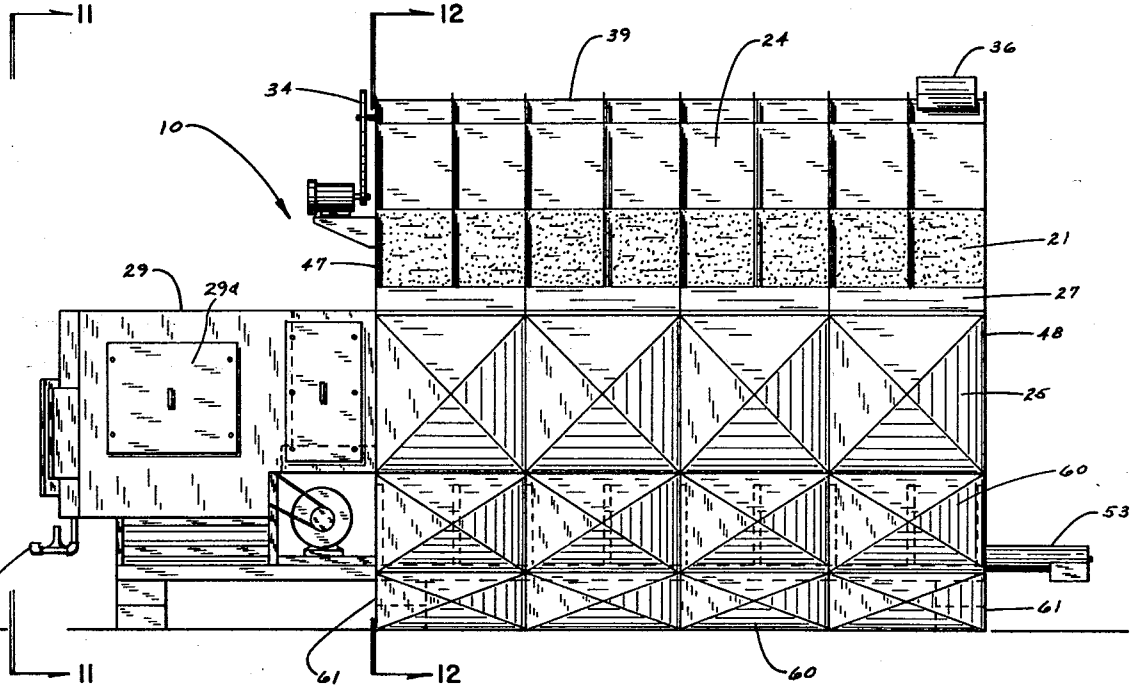
FIG. 10 is a side elevational view of the preferred embodiment of the present invention showing solid panels connected to the exhaust duct and enclosing the base of the dryer.
Figure 11:
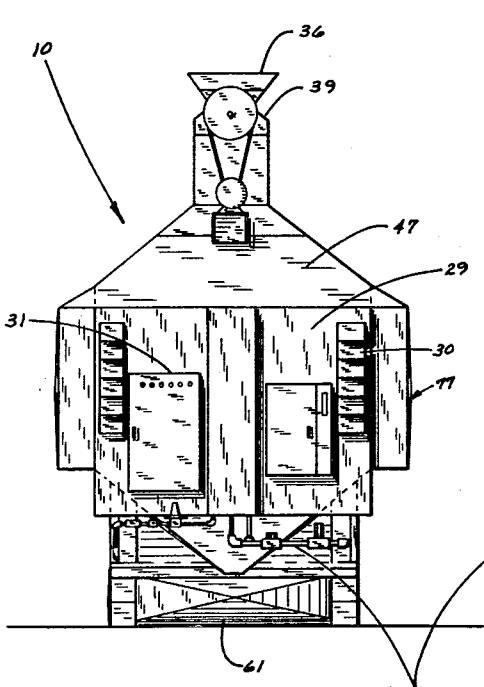
FIG. 11 is a front view of the preferred embodiment taken along line 11—11 of FIG. 10.
Figure 12:
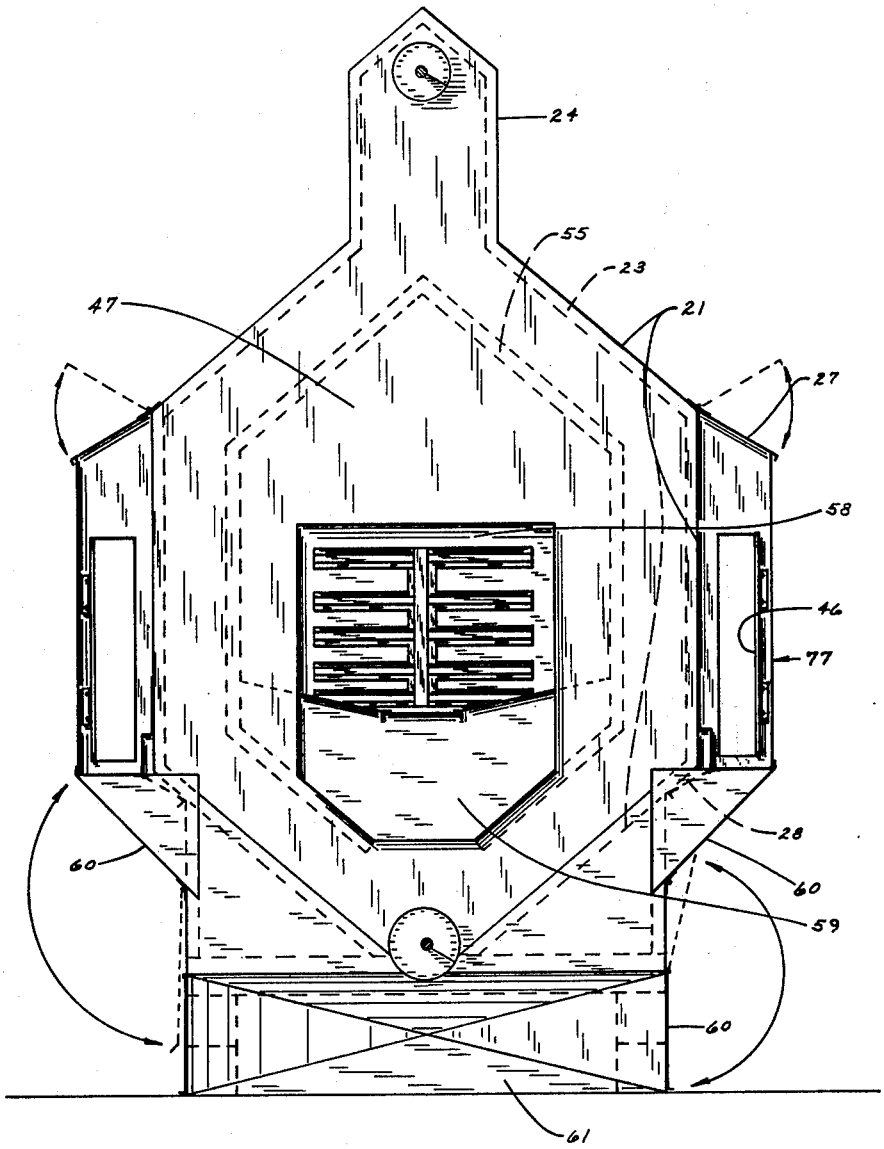
FIG. 12 is a cross-sectional view taken along line 12—12 of FIG. 10.

The plenum floor panels, 50, are sloped downward from the plenum walls to the center of the plenum where they rest on a smooth longitudinal service walkway support panel 72 (FIG. 8) that provides a channel along the base of the slopes. The blower airflow causes foreign material that filters through the pervious walls to be blown down the slope to the smooth panel, then along the panel to the end of the heat plenum opposite the blower. An opening 71 in the longitudinal panel 72 at the back of the dryer is connected to a spout or duct 70 (FIGS. 8, 9 and 13) which allows the material to flow by gravity downward to a fluted airlock metering roll 73 which continuously meters the material plus a small volume of air into the grain flow being discharged by the unload conveyor 52 (FIG. 8).

This airflow and gravity discharge metering system keeps foreign material from collecting in the heat plenum, making the units much less susceptible to fire dangers.

The structure in this invention described previously is managed to do four separate but vitally important drying functions. Either a centrifugal or vaneaxial model can perform identically equal functions.

In the first situation where it is desired to dry a grain such as corn that is not considered by the grain trade to contain flammable or explosive particles or dusts optimum dryer fuel efficiency is desired. To optimize the fuel efficiency, drying is accomplished by leaving the air splitter 42 (FIG. 4) or 95 (FIG. 16) in a closed position and the air control box door panel(s) 45 (FIG. 4) or 94 (FIG. 16) open, thus allowing pressure heated air drying and suction cooling air return to the blower inlet, along with return of the lower portion of the exhaust heated air. Normally, the sidewall air duct top and bottom doors 27 and 28 are closed, while the air duct air return valve door 46 (FIG. 7) is fully open allowing all the sidewall airflow to be returned. If overcooling of the grain occurs, the louvers 30 (FIG. 4) or 91 (FIG. 16) can be opened to reduce the suction pressure, which reduces the amount of cooling air pulled through the grain and allows the blower to develop a higher airflow.

If the grain is not cool enough, the louvers 30 and 91 are left closed, the top exhaust panels 27 are opened to an intermediate position, and the air valve doors 46 are partially closed to reduce the amount of return exhaust heated airflow and increase the amount of blower suction, thus increasing the cooling airflow to a desired amount, optimizing cooling of the grain.

The air exhausting from the sidewall of the dryer then seeks the path of least resistance where part of the air is drawn back to the blower while a portion exhausts to atmosphere, keeping the drying airflow volume through the intermediate section of the grain column flowing at about the same flow rate regardless of the cooling procedure used.

A second method of drying is set up for crops such as milo or sunflowers which are considered to have extremely hazardous residues, such as dusts, hairs, etc. During this drying, all airflow is desired to be exhausted to atmosphere with no airflow being recirculated. To accomplish this, the door panels 45 and 94 at the sides of the air control box of the airflow transition are closed, the "air splitter" 42 and/or 95 is elevated to a desired position by cable assemblies 43 and 44, the air duct control valve doors are closed, blocking air return, ambient airflow louvers 30 and 91 are fully opened and the exhaust duct panels 27 and 28 are fully opened, exhausting all airflow, both cooling and heating by positive plenum pressure, still with optimum grain cooling airflow and all remaining airflow going to drying.

The third process is where no cooling is desired, such as with "Dryeration or Combination Drying" with all airflow exhausted. The airflow control box doors 45 and 94 and "air splitters" 42 and 95 are left closed, the plenum divider panels 50 are opened, exhaust doors 27 and 28 are opened, and air valve control doors 46 are closed. Thus all the grain column is used for heat, speeding up the drying rate without any airflow recirculation.

The fourth process utilizes "Dryeration or Combination Drying" with recirculation of exhaust heated airflow.

The airflow control box doors 45 and 94 as well as the "air splitter" 42 and 95 are closed, the plenum divider panels 50 are opened, the exhaust duct return air doors 27 are closed, the air control door 46 is fully open, and louvers 30 and 91 are adjusted to allow the same amount of airflow to enter as is exhausted from the top of the structure. An additional set of panels 60 and 61 shroud the entire base of the dryer so that air exhausting by pressure from the lower slope of the dryer will be forced through open doors 28 thus return all lower and intermediate airflow to be returned to the blower inlet reduce fuel consumption significantly.

The four basic adjustment configurations of the preferred embodiment are shown in FIGS. 17, 18, 19 and 20, illustrating the functions of adjustable control elements 27, 28, 30, 31, 33, 34, 42, 45, 46, 50, 51, 52, 60 and 61. These figures show the entire working process of the airflow in each separate and independent drying mode.

Figure 17:
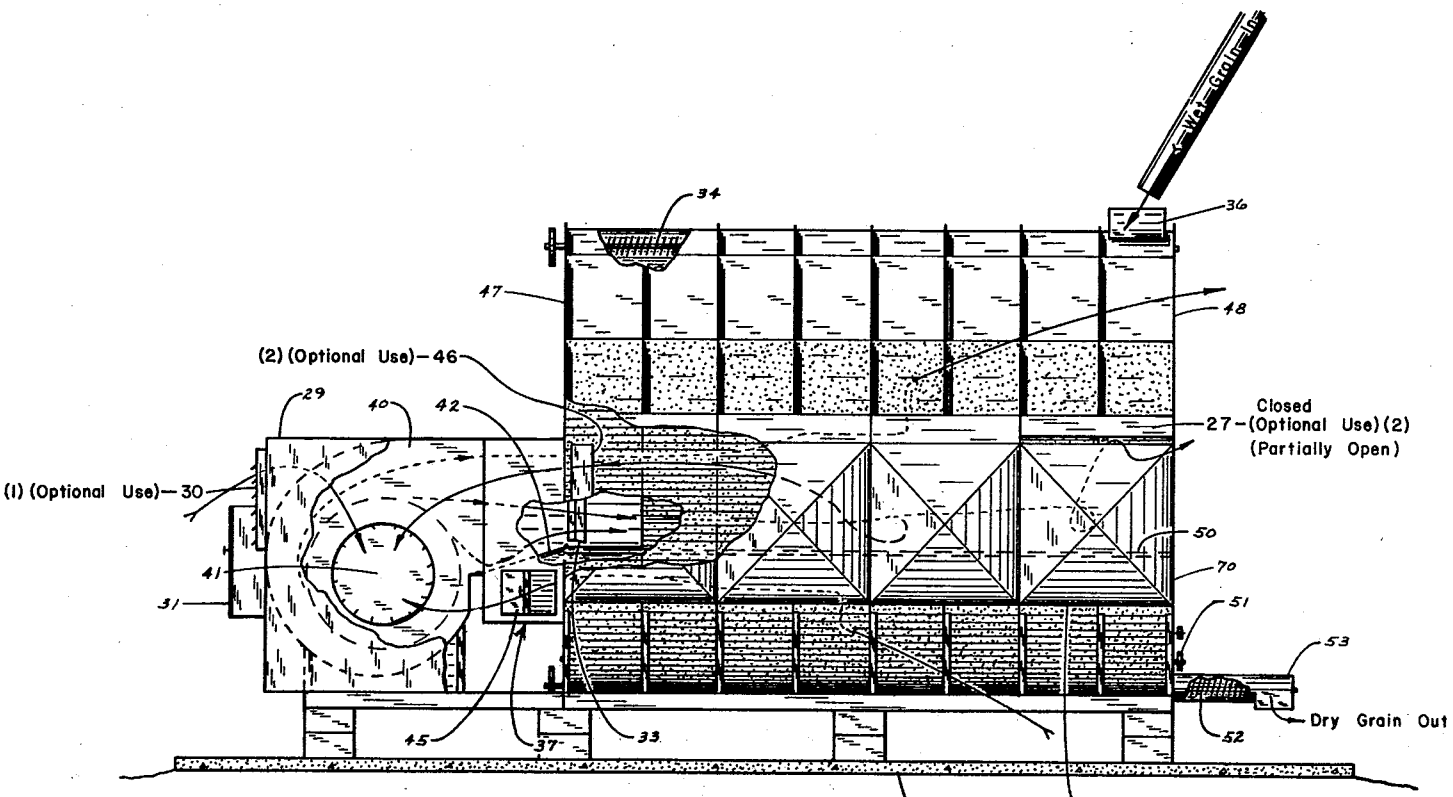
FIG. 17 is a partial cutaway side elevational view of the preferred embodiment showing pressure drying, suction cooling, and recirculation of warmed cooling air and the very warm portion of exhaust heated air.

FIG. 17 shows the energy efficient pressure drying, suction cooling partial exhaust heat recycling process where ambient fresh air is controlled as an option by operating ambient air inlet vent 30 if needed to reduce cooling airflow and thus give optimum blower output. Also, increased cooling can be obtained as an option by partially closing air duct valve 46 and setting top exhaust duct vent 27 to the intermediate position while keeping the air splitter 42 closed, plenum divider panel 50 closed, and ambient air vent 30 closed to provide increased suction to the cooling plenum 59, through the air box open doors 45, thus pulling more air through the grain cooling zone, thereby recovering a desired level of energy from the cooling grain.

Figure 18:
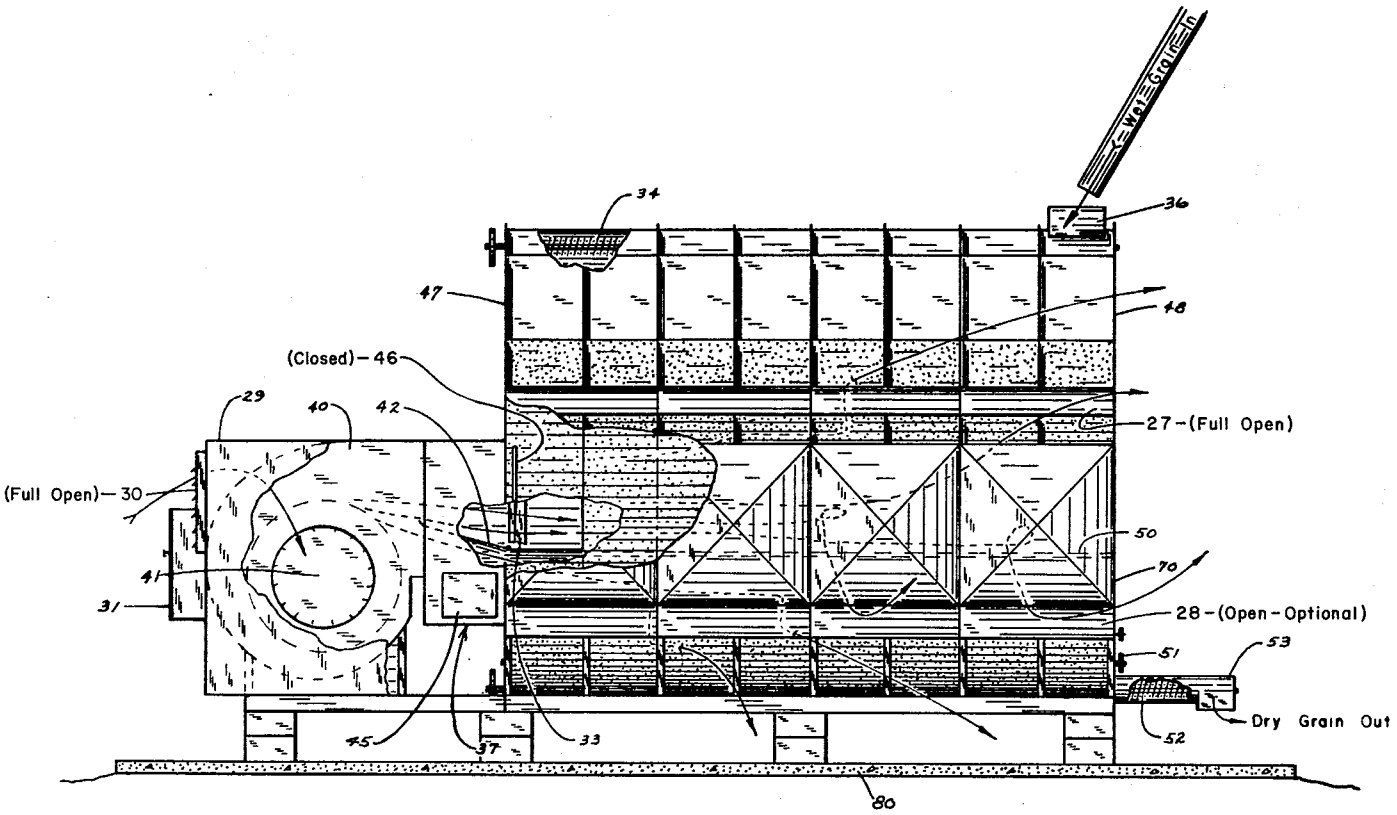
FIG. 18 is a partial cutaway side elevational view of the preferred embodiment showing pressure drying and cooling with full exhaust of all airflow.

FIG. 18 shows the safer full exhaust pressure dry and pressure cool process used when drying grain with easily inflammable residue. All air to the blower inlet 41 is drawn through fully open ambient air inlet vent 30. With more grain column area and greatly reduced suction pressure, the blower total airflow and thus the drying capacity is increased. Return exhaust air duct valve 46 is closed, exhaust air duct vents 27 and 28 are fully open; plenum divider panels 50 and air box doors 45 are closed on air box structure 37; "air splitter" 42, which forms the top of air box 37, is adjusted to a desired setting providing an adequate positive pressure cooling airflow through air box 37 into cooling plenum 59 for optimum cooling of the grain, providing all additional air from the blower 40 outlet to flow through heater 33 for drying the grain and for blowing any residue or foreign material in the plenum to the automatic cleanout sump mechanism 70 at the rear of the heat plenum 58 for continuous metering through the air lock metering system into the grain being conveyed by the unload conveyor 52 from the discharge structure 53, thus providing maximum safety in drying.

Figure 19:
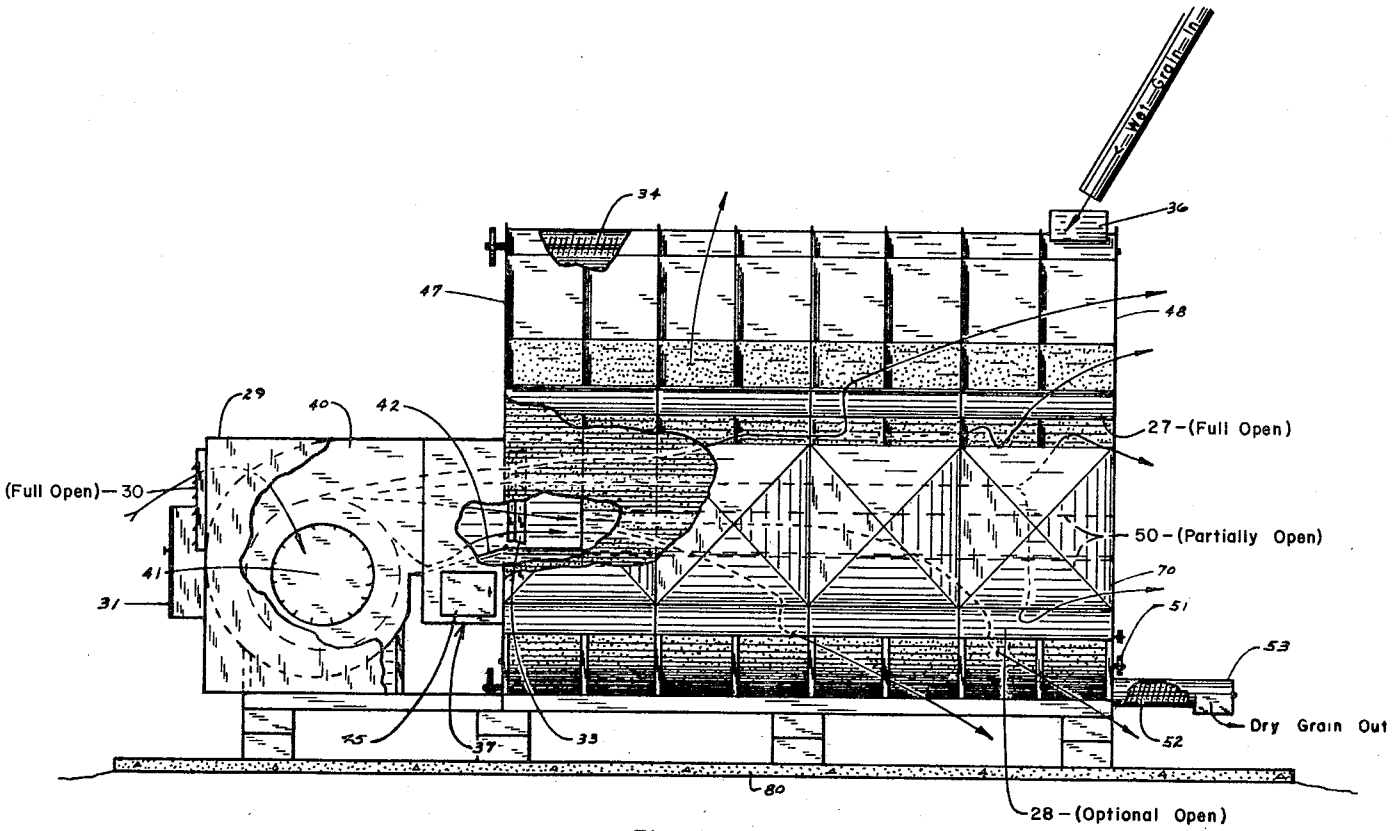
FIG. 19 is a partial cutaway side elevational view of the preferred embodiment showing pressure drying in the entire structure, no cooling, and all air exhausting.

FIG. 19 demonstrates the process of using the entire plenum zone 57 for heat in the case where no cooling in the dryer is desired such as when using "Dryeration" or "Combination Drying" processes in drying a crop with highly inflammable residues or foreign material thus requiring that all air be exhausted from the dryer. Ambient air inlet vent 30 is fully opened; "air splitter" panel 42, air box doors 45, and air duct valves 46 are fully closed. Exhaust duct vents 27 and 28 are fully opened. Plenum divider panels 50 are at least alternately opened to an intermediate position to allow heated air to flow unrestricted from heat plenum 58 into cooling plenum 59, thus forcing heated air throughout all the grain column exposed to the plenum chamber 57. With pressure airflow going to the entire plenum 57 and through all the grain column and no suction cooling, the total blower output is increased, thus increasing total drying capacity.

Figure 20:
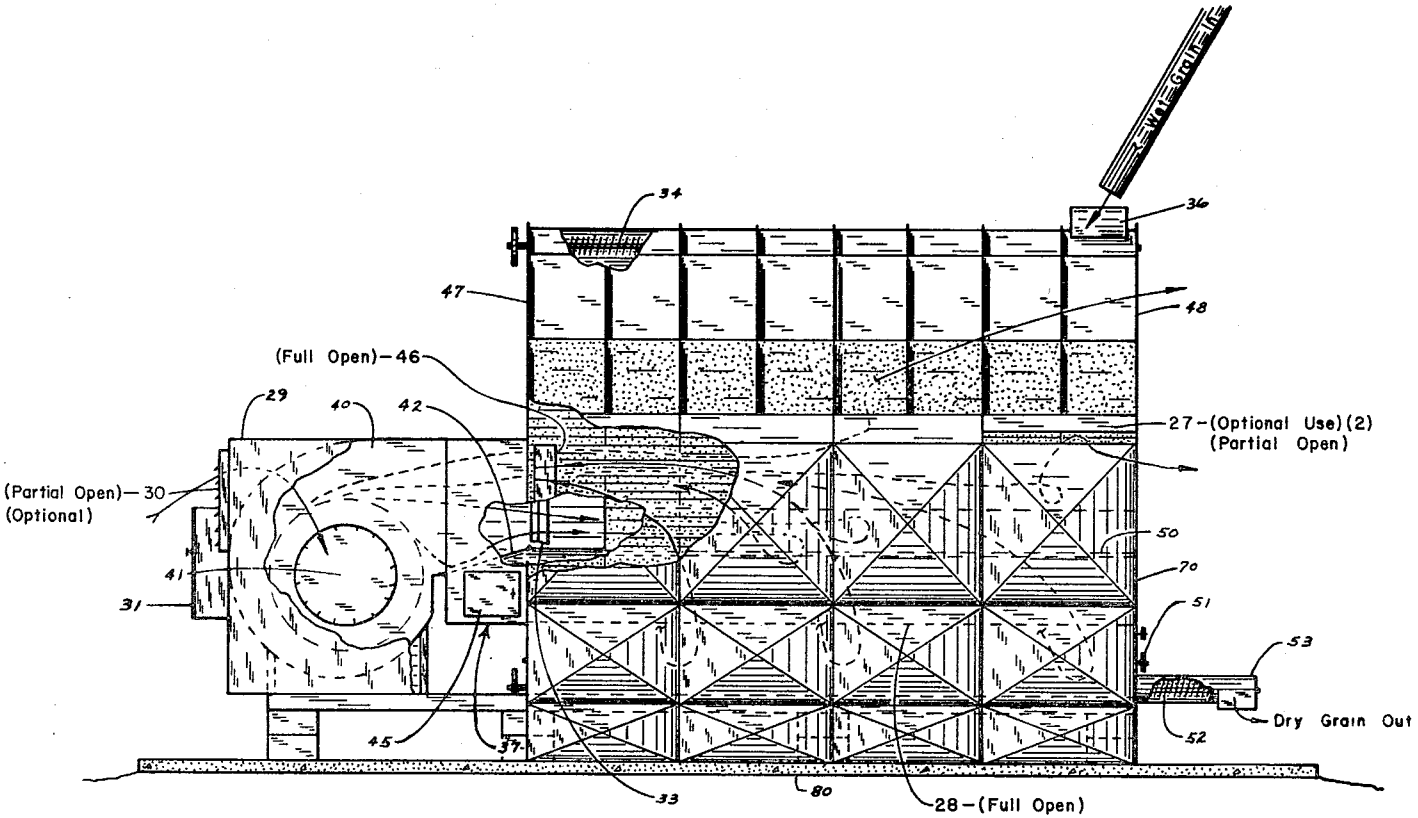
FIG. 20 is a partial cutaway view of the preferred embodiment showing pressure drying in the entire structure, no cooling, and a desired portion of the warmer, drier exhaust air being recirculated to the blower inlet.

FIG. 20 shows the dryer using the entire plenum chamber 57 for heat, as in FIG. 19, for use with "Dryeration" or "Combination Drying" of crops such as rice or corn where recirculation of very warm exhaust air, which has a desirable level of humidity when no cooling of the grain is desirable. To set the machine for operation, ambient air vent 30 is partially open and is adjusted to balance the amount of fresh airflow into the blower inlet with the volume of air to be exhausted from the position of the heat zone above the exhaust duct top vent 27. Top exhaust air duct vent 27 may be partially opened to the intermediate position when drying very wet grain to allow a portion of the upper exhaust air in the duct to be discharged to atmosphere. "Air splitter" 42 and air box doors 45 are fully closed, plenum divider doors 50 are opened to a desired intermediate position to communicate heated air from heat plenum zone 58 to cooling plenum zone 59, thus drying grain throughout the entire grain column. Exhaust duct valves 46 are fully open; the base structure 11 of the dryer is fully enclosed by end panels 61 and side panels 60 so that with bottom exhaust doors 28 in the fully open position, very warm dry airflow exhausting from the lower grain slopes can be routed from under the dryer back into the exhaust air duct through open door 28, thus back to the blower inlet for reuse along with a portion or all of the air from the grain column adjacent the exhaust air duct structure. Thus, the dryer can be operated at a higher grain flow rate with all of the grain column 12 and plenum chamber 57 being utilized for heated air drying; the drying efficiency is near optimum since even the heat energy exhausted in the hot grain, being controlled by metering rolls 51 and conveyed by unload conveyor 52 to discharge point 53, is used to dry the grain from its discharge moisture level to its final storage level is used by moving a slow rate of natural or low temperature air through the hot "sweaty" grain; thus, an extremely high rate of drying efficiency is provided on the final moisture removed from the grain, which is very difficult to remove in the dryer.

Although not illustrated, the dryer when adjusted for drying without cooling (as in FIG. 19) can also be used as a "batch" dryer by stopping metering roll 51, switching the load conveyor 34 and unload conveyor 52 off, and monitoring the dryness of the grain. Cooling of each batch can be accomplished by shutting off the heater 33 by controlling plumbing 32 from control panel 30, allowing blower 40 to continue moving ambient air throughout the entire grain column until a sufficient amount of heat is removed from the grain. Then blower 40 is stopped and unload conveyor 52 is started; meters 51 are turned up to a high rate of speed for fast unloading of the dryer. Although not necessarily desirable as a continuous method, the dryer can be easily operated in a manual mode, adding greatly to the operator's flexibility when small volumes of wet grain need to be processed at the beginning and end of the harvest season.

Figure 21:
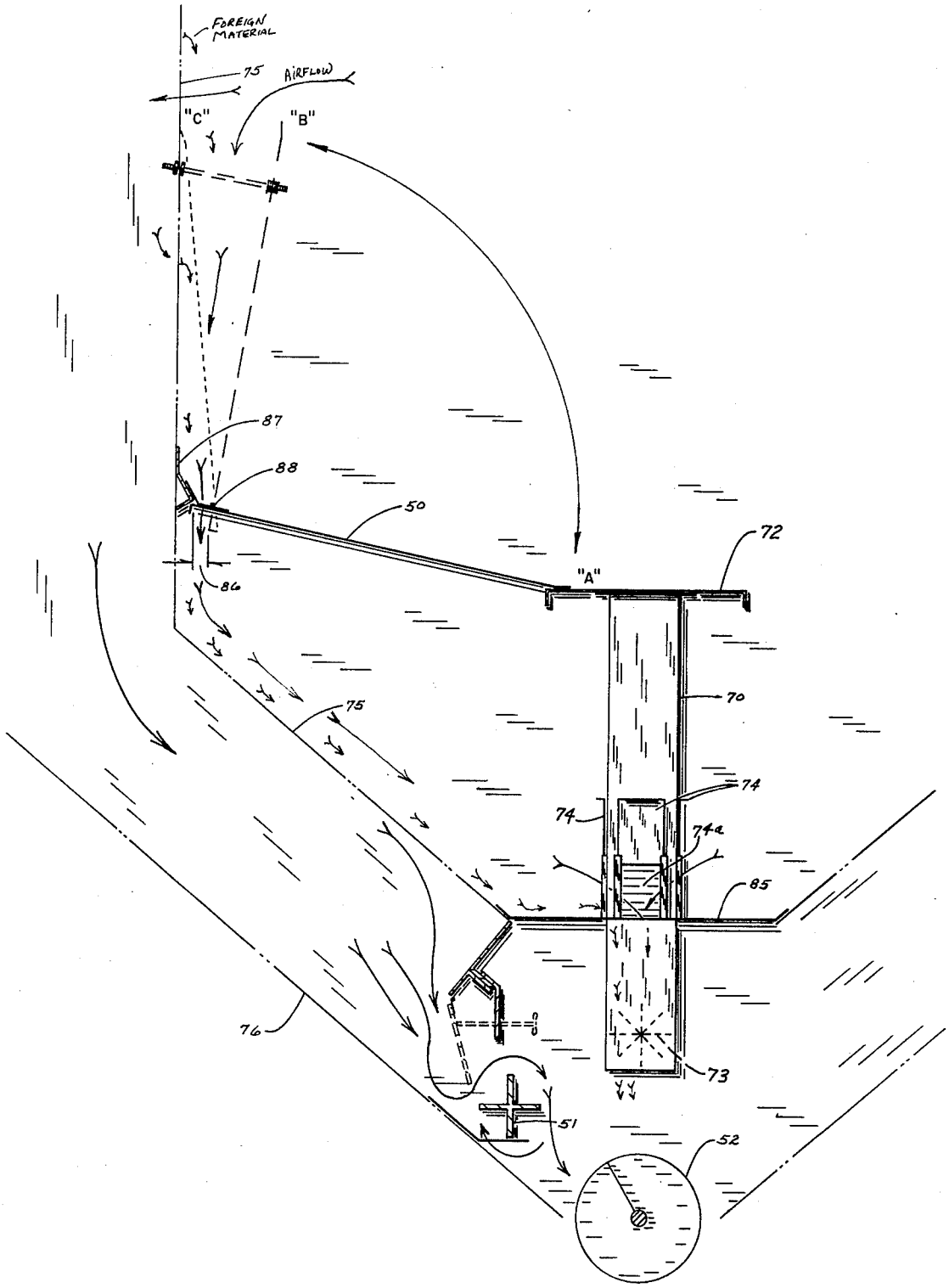
FIG. 21 is a partial cross-sectional view of the lower portion of the plenum, grain column structure, and grain flow control apparatus showing the plenum divider and automatic plenum cleanout design for full heat drying.

FIG. 21 illustrates a very important safety feature of this embodiment when used with the dryer operating as shown in FIGS. 19 and 20, with plenum divider panels 50 opened to the intermediate position for drying without cooling on a continuous flow basis or with batch drying as in FIG. 19.

By designing the plenum door panel hinge 88 so that the hinge point is offset from the edge of the panel by a significant distance, when the panel is partially opened to the intermediate position, "B", FIG. 21, any "fines", dust, or other foreign material that is discharged through the vertical and upper sloped sidewalls of the inner pervious wall 75 or is blown between the wall 75 and the plenum door panel 50, will continue moving downward by gravity through the large gap 86 that is provided between the hinge bracket 87 fixed to wall 75 and the panel surface adjacent the offset hinge 88 mounting point on panel 50, thus eliminating a buildup of overly dry combustible materials which could be easily ignited.

The foreign material falling through the hinge gap 86 onto the lower slope of the inner pervious wall 75 is then blown laterally down the slope until it reaches the metering roll access door panels 85, which form a channel along the bottom of plenum chamber 57, connecting adjacent sides of wall panels 75. The airflow then blows the foreign material to the rear of the plenum chamber along the formed channel until it reaches the automatic cleanout device structure 70 where it is blown into one of the access openings 74*a* covered and sealed during normal cooling operation by cleanout panel covers 74, which are opened during full heat drying only, where the material is metered through the air lock fluted meter 73 into the dry grain being discharged by conveyor 52 out of discharge structure 53. This provides a much improved and safer dryer.

It should be noted that the second embodiment using vaneaxial blowers as seen in FIGS. 14, 15 and 16, or other types of air moving means, operates substantially the same as the first embodiment shown in FIGS. 17, 18, 19 and 20.

Obviously, many modifications and variations of the present invention are possible in light of the above teachings. It is therefore to be understood that, within the scope of the appended claims, the invention may be practiced otherwise than as specifically described.

We claim:

1. Apparatus for drying and conditioning grain comprising:

wall means including an upper portion, a lower portion and an intermediate portion between the upper and lower portions, for containing and guiding grain downwardly by gravity from the upper portion to the lower portion;

air flow means connected to said wall means for permitting air to pass through the grain as such grain moves downwardly;

a plenum chamber in communication with said air flow means;

plenum divider means for separating said plenum chamber into a first zone and a second zone;

air circulation means, including an inlet and an outlet, for causing air movement;

means for connecting the outlet of the air circulation means to the first zone of the plenum chamber whereby said first zone is pressurized and air is thereby forced through a first portion of the air flow means for drying the grain;

means for heating the air being forced into said first zone of the plenum chamber;

recirculation means for selectively directing at least some of the heated air that has passed through the grain back to the inlet of the air circulation means; and means for selectively directly connecting the second zone of the plenum chamber to the inlet of the air circulation means for causing ambient air to be drawn through a second portion of the air flow means for cooling the grain when said connecting means is open and causing the air in the second zone to be forced through said second portion of the grain when said connecting means is closed.

2. The apparatus of claim 1 wherein said second zone is connected to the inlet of the air circulation means whereby ambient air is drawn through the second portion of the air flow means and is heated by the warm grain before entering the inlet of the air circulation means.

3. The apparatus of claim 1 wherein said plenum divider means sealingly separates the first zone from the second zone.

4. The apparatus of claim 3 wherein the plenum divider means is selectively moveable from a position sealing the first zone from the second zone to a position allowing the first and second zones to be in direct fluid communication with respect to each other.

5. The apparatus of claim 2 wherein said means for connecting the second zone of the plenum chamber to the inlet of the air circulation means includes closing means for selectively closing off the second zone from the inlet of the air circulation means.

6. The apparatus of claim 5 including means for selectively causing a portion of the flow from said air circulation means to be diverted to said second zone when said closing means is in said closing off position whereby said air circulation means supplies heated air to said first zone and ambient air to said second zone of the plenum chamber.

7. The apparatus of claim 6 including ambient air inlet means for selectively and controllably communicating ambient air with the inlet of said air circulating means.

8. The apparatus of claim 2 including ambient air inlet means for selectively and controllably communicating ambient air with the inlet of said air circulating means.

9. The apparatus of claim 1 wherein said plenum divider means comprises at least one door pivotally attached at one end thereof adjacent an intermediate portion of said wall means; platform means located in said plenum chamber and attached to the plenum chamber structure, the other end of said door being in abutment with said platform means and lower than said pivotally attached end, thus creating a downwardly sloped surface from the pivotally attached end toward the platform means when said door is closed, for causing foreign matter to slide down onto said platform means, to an opening disposed in one end of said platform being opposite the air circulation means, the other end of said platform means having an opening therein for receiving foreign material which is blown rearwardly into said opening by said air circulation means, means attached to and disposed below said opening and platform means for guiding said foreign material downwardly; a metering roll disposed intermediate the top and the bottom of said guiding means for continuously metering said foreign material out from said guiding means, said metering means including air lock means for allowing some air to escape during each metering cycle, preventing substantial amounts of the pressurized air within the plenum chamber from passing therethrough.

10. The apparatus of claim 9 including means connected to said metering means and guiding means for directing and discharging said foreign material into the dried grain passing through said wall means as it is discharged from said drying and conditioning apparatus.

11. Apparatus for drying and conditioning grain comprising:

wall means including an upper portion, a lower portion and an intermediate portion between the upper and lower portions, for containing and guiding grain downwardly by gravity from the upper portion to the lower portion;

air flow means connected to said wall means for permitting air to pass through the grain as such grain moves downwardly;

a plenum chamber in communication with said air flow means;

plenum divider means for separating said plenum chamber into a first zone and a second zone, said plenum divider means sealingly separates the first zone from the second zone and is selectively movable from a position sealing the first zone from the second zone, whereby the air in the first zone is forced through the first portion of the air flow means, to a position allowing the first and second zones to be in direct fluid communication with respect to each other, whereby the air in the first zone passes directly into the second zone;

air circulation means, including an inlet and an outlet, for causing air movement;

means for connecting the outlet of the air circulation means to the first zone of the plenum chamber whereby said first zone is pressurized and air is thereby forced through a first portion of the air flow means for drying the grain;

means for heating the air being forced into said first zone of the plenum chamber; and recirculation means for selectively directing at least some of the heated air that has passed through the grain back to the inlet of the air circulation means.

12. The apparatus of claim 11 wherein said recirculation means comprises a return duct means connected to said intermediate portion of the wall means for collecting air which has passed through the air flow means on the intermediate portion of the wall means.

13. The apparatus of claim 12 including a first exhaust vent means on said return duct means for selectively allowing air to be exhausted to atmosphere therethrough.

14. The apparatus of claim 13 including a second exhaust vent means on the bottom of said return duct means for selectively allowing air to be exhausted therethrough and facilitating cleaning of foreign material from the duct means.

15. The apparatus of claim 12 including means for connecting the return duct means to the inlet of the air circulation means; and, air duct valving means for controlling the flow of air from the return duct means to the inlet of the air circulation means and being adjustable between an open and a closed position.

16. Apparatus for drying and conditioning grain comprising:

wall means including an upper portion, a lower portion and an intermediate portion between the upper and lower portions, for containing and guiding grain downwardly by gravity from the upper portion to the lower portion;

air flow means connected to said wall means for permitting air to pass through the grain as such grain moves downwardly;

a plenum chamber in communication with said air flow means;

plenum divider means for separating said plenum chamber into a first zone and a second zone;

air circulation means, including an inlet and an outlet, for causing air movement;

means for connecting the outlet of the air circulation means to the first zone of the plenum chamber whereby said first zone is pressurized and air is thereby forced through a first portion of the air flow means for drying the grain;

means for heating the air being forced into said first zone of the plenum chamber;

diverting means for selectively causing a portion of the flow from said air circulation means to be diverted to said second zone of the plenum chamber, upstream of said heating means, whereby said air circulation means supplies ambient air to said second zone and heated air to said first zone or alternately allowing all of the air from the outlet of said air circulation means to pass through the heating means; and means for selectively directly connecting the second zone of the plenum chamber to the inlet of the air circulation means for causing ambient air to be drawn through a second portion of the air flow means for cooling the grain when said connecting means is open and causing the air in the second zone to be forced through said second portion of the grain when said connecting means is closed.

17. The apparatus of claim 16 wherein said diverting means comprises a plate hingedly connected at one end thereof adjacent the heating means and pivotable between a first position wherein the other end closes off the flow to the second zone and causes all flow to go to the first zone and at least one other pivotal position wherein flow from said air circulation means is forced into both of the first and second zones.

18. The apparatus of claim 16 including recirculation means for selectively directing at least some of the heated air that has passed through the grain back to the inlet of the air circulation means.

19. The apparatus of claim 18 including first and second exhaust vents in said recirculation means for balancing airflows through the wall means.

20. The apparatus of claim 18 including ambient air inlet means for permitting ambient air to be in direct communication with the inlet of the air circulating means.

21. A method of drying and conditioning grain or other moist particulate granular particles utilizing a wall means, including an upper portion, a lower portion and an intermediate portion between the upper and lower portions, for containing and guiding grain downwardly by gravity from the upper portion to the lower portion; air flow means connected to said wall means for permitting air to pass through the grain as such grain moves downwardly; a plenum chamber in communication with said air flow means; plenum divider means for separating said plenum chamber into a first zone and a second zone; air circulation means, including an inlet and an outlet, for causing air movement; means for selectively either connecting the outlet of the air circulation means to the first zone of the plenum in a first position thereof or being movable to a second position for causing outlet air to be forced into both of said first and second zones; means for heating the air being forced into said first zone of the plenum chamber; recirculation means for selectively directing at least some of the heated air that has passed back through the grain back to the inlet of the air circulation means and including a return duct means connected to an intermediate portion of the wall means for collecting air which has passed through the air flow means on the intermediate portion of the wall means; an exhaust vent on said return duct means, said exhaust vent being movable between an open and a closed position; means for fluidly connecting the return duct means to the inlet of the air circulation means; ambient air inlet means for selectively and controllably communicating ambient air with the inlet of said air circulating means; air duct valving means for controlling the flow of air from the return duct means to the inlet of the air circulation means and being adjustable between an open and a closed position; means for selectively either connecting the second zone of the plenum chamber to the inlet of the air circulation means for drawing ambient air in through a second portion of the air flow means or preventing the second zone from being in communication with the inlet of the air circulation means; and, means for controlling the grain flow rate as the grain passes through the wall means, said grain flow control means having a range of flow rate between no grain movement and a high rate of grain flow suitable for drying all moisture levels of grain; said method comprising:

setting said grain flow control means at a desired setting thereby causing the grain to move through the wall means at a rate suitable for removing the desired amount of moisture from the grain;

controlling the level of heat added to the air from the air circulation means communicated to the first zone;

connecting the second zone of the plenum chamber with the inlet of the air circulation means;

connecting the outlet of the air circulation means to the first zone and preventing the outlet from communicating with the second zone;

adjusting said ambient air inlet means to control the exhaust temperature of the grain, thereby raising or lowering the inlet suction pressure on the air circulating means and allowing the air circulation means to operate at an optimum grain cooling performance level by drawing more or less air through to the second zone so that the grain is not cooled more or less than is necessary, then pushing as much air as the air circulation means is capable of providing under the optimum cooling suction inlet conditions;

opening said air duct valving means on the return duct means to allow suitable heated air that has passed through the grain to return to the inlet of the air circulation means;

closing the exhaust vent of the duct means for causing all of the air in the duct means to be returned to said inlet of the air circulation means when the air duct valving means is fully open and opening said exhaust vent to a suitable position intermediate the closed and fully open position for allowing the exhausting air to establish whether it will exhaust to atmosphere or be drawn back to the air circulation means inlet based on the relative positive or negative pressures that exist within said exhaust air duct means when said air duct valving means is less than fully open for causing more or less suction at the air circulation means inlet for drawing the desired amount of cooling air through the second zone of the plenum chamber.

22. A method of drying and conditioning grain or other moist particulate granular particles utilizing a wall means, including an upper portion, a lower portion and an intermediate portion between the upper and lower portions, for containing and guiding grain downwardly by gravity from the upper portion to the lower portion; air flow means connected to said wall means for permitting air to pass through the grain as such grain moves downwardly; a plenum chamber in communication with said air flow means; plenum divider means for separating said plenum chamber into a first zone and a second zone; air circulation means, including an inlet and an outlet, for causing air movement; means for selectively either connecting the outlet of the air circulation means to the first zone of the plenum in a first position thereof or being movable to a second position for causing outlet air to be forced into both of said first and second zones; means for heating the air being forced into said first zone of the plenum chamber; recirculation means including cooling air return valving means for allowing or preventing communication of the second zone of the plenum with the inlet of the air circulation means and a return duct means connected to an intermediate portion of the wall means for collecting air which has passed through the air flow means on the intermediate portion of the wall means; an exhaust vent on said return duct means, said exhaust vent being movable between an open and a closed position; means for fluidly connecting the return duct means to the inlet of the air circulation means; ambient air inlet means for selectively and controllably communicating ambient air with the inlet of said air circulating means; air duct valving means for controlling the flow of air from the return duct means to the inlet of the air circulation means and being adjustable between an open and a closed position; means for selectively either connecting the second zone of the plenum chamber to the inlet of the air circulation means for drawing ambient air in through a second portion of the air flow means or preventing the second zone from being in communication with the inlet of the air circulation means; and, means for controlling the grain flow rate as the grain passes through the wall means, said grain flow control means having a range of flow rate between no grain movement and a high rate of grain flow suitable for drying all moisture levels of grain; said method comprising:

setting said grain flow control means at a desired setting thereby causing the grain to move through the wall means at a rate suitable for removing the desired amount of moisture from the grain;

controlling the level of heat added to the air from the air circulation means communicated to the first zone;

preventing the second zone of the plenum chamber from being in communication with the inlet of the air circulation means by closing the cooling air return valving means;

connecting the outlet of the air circulation means to both of the first zone and the second zone for causing full pressure heating in the first zone and full pressure cooling in the second zone and adjusting the amount of air directed to the second zone to achieve only as much cooling of the grain as is necessary;

opening said ambient air inlet means for allowing adequate airflow to the inlet of the air circulation means;

closing said air duct valving means on the return duct means to prevent heated air that has passed through the grain to return to the inlet of the air circulation means; and opening the exhaust vent of the duct means enough for allowing the air in the duct means to be exhausted with minimum restriction to atmosphere thereby balancing the flow through all portions of the air flow means.

23. A method of drying and conditioning grain or other moist particulate granular particles utilizing wall means, including an upper portion, a lower portion and an intermediate portion between the upper and lower portions, for containing and guiding grain downwardly by gravity from the upper portion to the lower portion; air flow means connected to said wall means for permitting air to pass through the grain as such grain moves downwardly; a plenum chamber in communication with said air flow means; plenum divider means for selectively separating said plenum chamber into a first zone and a second zone or allowing communication between the first and the second zones; air circulation means, including an inlet and an outlet, for causing air movement; means for selectively either connecting the outlet of the air circulation means to the first zone of the plenum in a first position thereof or being movable to a second position for causing outlet air to be forced into both of said first and second zones; means for heating the air being forced into said first zone of the plenum chamber; recirculation means including cooling air return valving means for allowing or preventing communication of the second zone of the plenum with the inlet of the air circulation means and a return duct means connected to an intermediate portion of the wall means for collecting air which has passed through the air flow means on the intermediate portion of the wall means; an exhaust vent on said return duct means, said exhaust vent being movable between an open and a closed position; means for fluidly connecting the return duct means to the inlet of the air circulation means; ambient air inlet means for selectively and controllably communicating ambient air with the inlet of said air circulating means; air duct valving means for controlling the flow of air from the return duct means to the inlet of the air circulation means and being adjustable between an open and a closed position; means for selectively either connecting the second zone of the plenum chamber to the inlet of the air circulation means for drawing ambient air in through a second portion of the air flow means or preventing the second zone from being in communication with the inlet of the air circulation means; and, means for controlling the grain flow rate as the grain passes through the wall means, said grain flow control means having a range of flow rate between no grain movement and a high rate of grain flow suitable for drying all moisture levels of grain; said method comprising:

setting said grain flow control means at a desired setting thereby causing the grain to move through the wall means at a rate suitable for removing the desired amount of moisture from the grain;

controlling the level of heat added to the air from the air circulation means communicated to the first zone;

preventing the second zone of the plenum chamber from being in communication with the inlet of the air circulation means by closing the cooling air return valving means;

connecting the outlet of the air circulation means to the first zone;

opening said plenum divider means to thereby allow direct communication of the first zone with the second zone thereby causing full pressure heating in both of the first and second zones;

opening said ambient air inlet means to allow adequate ambient air to directly enter the inlet of the air circulation means;

closing said air duct valving means on the return duct means for preventing heated air that has passed through the grain to return to the inlet of the air circulation means;

opening the exhaust vent of the duct means enough for causing all of the air in the duct means to be exhausted with minimum restriction to atmosphere and thereby balancing the flow of heated air through all portions of the air flow means to provide full pressure heat to all such portions.

24. A method of drying and conditioning grain or other moist particulate granular particles utilizing a wall means, including an upper portion, a lower portion and an intermediate portion between the upper and lower portions, for containing and guiding grain downwardly by gravity from the upper portion to the lower portion, air flow means connected to said wall means for permitting air to pass through the grain as such grain moves downwardly; a plenum chamber in communication with said air flow means; plenum divider means for selectively separating said plenum chamber into a first zone and a second zone; or allowing communication between the first and the second zones; air circulation means, including an inlet and an outlet, for causing air movement; means for selectively either connecting the outlet of the air circulation means to the first zone of the plenum in a first position thereof or being movable to a second position for causing outlet air to be forced into both of said first and second zones; means for heating the air being forced into said first zone of the plenum chamber; recirculation means including cooling air return valving means for allowing or preventing communication of the second zone of the plenum with the inlet of the air circulation means and a return duct means connected to an intermediate portion of the wall means for collecting air which has passed through the air flow means on the intermediate portion of the wall means; a first and a second exhaust vent on said return duct means and each said exhaust vent being movable between open and closed positions; means for fluidly connecting the return duct means to the inlet of the air circulation means; ambient air inlet means for selectively and controllably communicating ambient air with the inlet of said air circulating means; air duct valving means for controlling the flow of air from the return duct means to the inlet of the air circulation means and being adjustable between an open and a closed position; means for selectively either connecting the second zone of the plenum chamber to the inlet of the air circulation means for drawing ambient air in through a second portion of the air flow means or preventing the second zone from being in communication with the inlet of the air circulation means; and, means for controlling the grain flow rate as the grain passes through the wall means, said grain flow control means having a range of flow rate between no grain movement and a high rate of grain flow suitable for drying all moisture levels of grain; said method comprising:

setting said grain flow control means at a desired setting thereby causing the grain to move through the wall means at a rate suitable for removing the desired amount of moisture from the grain;

controlling the level of heat added to the air from the air circulation means communicated to the first zone;

preventing the second zone of the plenum chamber from being in communication with the inlet of the air circulation means by closing the cooling air return valving means;

connecting the outlet of the air circulation means to the first zone;

opening said ambient air inlet means to allow ambient air to directly enter the inlet of the air circulation means and adjusting said ambient air inlet means for balancing the inlet airflow volume with the high humidity air exhausted to atmosphere from the air flow means in the upper portion of the wall means;

opening said air duct valving means on the return duct means to allow suitable heated air that has passed through the grain to the inlet of the air circulation means;

closing the exhaust vent of the duct means for causing all of the air in the duct means to be returned to said inlet of the air circulation means, or partially opening the exhaust duct vent to the air duct means to allow a portion of the airflow entering the exhaust duct means, which may contain excessive humidity, to exhaust to atmosphere;

opening said plenum divider means to allow communication of the second zone with the first zone.

25. A method of drying and conditioning grain or other moist particulate granular particles utilizing a wall means, including an upper portion, a lower portion and an intermediate portion between the upper and lower portions, for containing and guiding grain downwardly by gravity from the upper portion to the lower portion; air flow means connected to said wall means for permitting air to pass through the grain as such grain moves downwardly; a plenum chamber in communication with said air flow means; plenum divider means for selectively separating said plenum chamber into a first zone and a second zone or allowing communication between the first and the second zones; air circulation means, including an inlet and an outlet, for causing air movement; means for selectively either connecting the outlet of the air circulation means to the first zone of the plenum in a first position thereof or being movable to a second position for causing outlet air to be forced into both of said first and second zones; means for heating the air being forced into said first zone of the plenum chamber; recirculation means including cooling air return valving means for allowing or preventing communication of the second zone of the plenum with the inlet of the air circulation means and a return duct means connected to an intermediate portion of the wall means for collecting air which has passed through the air flow means on the intermediate portion of the wall means; an exhaust vent on said return duct means, said exhaust vent being moveable between an open and a closed position; means for fluidly connecting the return duct means to the inlet of the air circulation means; ambient air inlet means for selectively and controllably communicating ambient air with the inlet of said air circulating means; and, air duct valving means for controlling the flow of air from the return duct means to the inlet of the air circulation means and being adjustable between an open and a closed position; means for selectively either connecting the second zone of the plenum chamber to the inlet of the air circulation means for drawing ambient air in through a second portion of the air flow means or preventing the second zone from being in communication with the inlet of the air circulation means; and, means for controlling the grain flow rate as the grain passes through the wall means, said grain flow control means having a range of flow rate between no grain movement and a high rate of grain flow suitable for drying all moisture levels of grain either continuously or in a stationary lot or batch; said method comprising:

setting said grain flow control means at a desired setting thereby causing the grain to move through the wall means at a rate suitable for removing the desired amount of moisture from the grain;

controlling the level of heat added to the air from the air circulation means communicated to the first zone;

preventing the second zone of the plenum chamber from being in communication with the inlet of the air circulation means by closing the cooling air return valving means;

connecting the outlet of the air circulation means to the first zone;

opening said plenum divider means to thereby allow direct communication of the first zone with the second zone thereby causing full pressure heating in both of the first and second zones;

opening said ambient air inlet means to allow adequate ambient air to directly enter the inlet of the air circulation means;

closing said air duct valving means on the return duct means for preventing heated air that has passed through the grain to return to the inlet of the air circulation means;

opening the exhaust vent of the duct means enough for causing all of the air in the duct means to be exhausted with minimum restriction to atmosphere and thereby balancing the flow of heated air through all portions of the air flow means to provide full pressure heat to all such portions;

shutting off the heating means at the end of a predetermined amount of time or when the temperature of the grain reaches a predetermined level;

continuing the operation of the air circulation means after the heating means is shut off until the grain is cooled to a predetermined temperature; and removing the dried and cooled grain from said wall means so the drying process can be repeated for another batch of grain.

26. Apparatus for drying and conditioning grain comprising:

wall means including an upper portion, a lower portion and an intermediate portion between the upper and lower portions, for containing and guiding grain downwardly by gravity from the upper portion to the lower portion;

air flow means connected to said wall means for permitting air to pass through the grain as such grain moves downwardly;

a plenum chamber in communication with said air flow means;

plenum divider means for selectively separating said plenum chamber into a first zone and a second zone, said plenum divider means including a door having an open position and a closed position; and hinge means for connecting said door to the wall means along a pivotal axis spaced from said wall means, said door being attached to said hinge means at a point spaced from the extreme ends thereof whereby when said door is closed the plenum divider substantially seals the first zone from the second zone and when the door is in the open position a space is formed between both sides of the door and the wall means whereby air and foreign matter can freely pass by both sides of the door and is prevented from accumulating in the area adjacent the hinge means;

air circulation means at one end of the plenum chamber, including an inlet and an outlet, for causing air movement;

means for connecting the outlet of the air circulation means to the plenum chamber;

means for heating the air being forced into said plenum chamber; and receiving means adjacent the bottom of the plenum chamber for receiving and automatically discharging foreign matter from said plenum chamber.

27. The apparatus of claim 26 wherein said receiving means includes a metering means for conveying said foreign matter out of said plenum chamber.

28. The apparatus of claim 27 including an opening between the metering means and the plenum chamber and means for selectively opening or closing said opening.

29. The apparatus of claim 27 wherein said metering means includes means for allowing a small amount of air from the plenum chamber to pass therethrough thereby causing the foreign matter to be forced towards the metering means but yet preventing the plenum chamber from losing its pressure.

* * * * *

UNITED STATES PATENT AND TRADEMARK OFFICE

CERTIFICATE OF CORRECTION

PATENT NO. : 4,268,971

DATED : May 26, 1981

INVENTOR(S) : Ronald T. Noyes, et al.

It is certified that error appears in the above-identified patent and that said Letters Patent is hereby corrected as shown below:

In column 12, line 4, "grain" has been changed to --air flow means--.

In column 13, line 19, "the", first occurrence thereof, has been changed to --a--.

In column 13, line 29, "a" has been changed to --said--.

In column 14, line 28, "grain" has been changed to --air flow means--.

Signed and Sealed this

Sixth Day of November, 1990

*Attest:*

*Attesting Officer*

HARRY F. MANBECK, JR.

*Commissioner of Patents and Trademarks*